US011501638B2

(12) United States Patent
Koshizen

(10) Patent No.: US 11,501,638 B2
(45) Date of Patent: Nov. 15, 2022

(54) TRAFFIC FLOW ESTIMATION APPARATUS, TRAFFIC FLOW ESTIMATION METHOD, AND STORAGE MEDIUM

(71) Applicant: HONDA MOTOR CO., LTD., Tokyo (JP)

(72) Inventor: Takamasa Koshizen, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 246 days.

(21) Appl. No.: 16/934,064

(22) Filed: Jul. 21, 2020

(65) Prior Publication Data

US 2021/0065541 A1 Mar. 4, 2021

(30) Foreign Application Priority Data

Aug. 27, 2019 (JP) ..... JP2019-154573

(51) Int. Cl.
*G08G 1/01* (2006.01)
*G08G 1/017* (2006.01)

(52) U.S. Cl.
CPC ..... *G08G 1/0145* (2013.01); *G08G 1/0133* (2013.01); *G08G 1/0141* (2013.01); *G08G 1/0175* (2013.01)

(58) Field of Classification Search
CPC .. G08G 1/0145; G08G 1/0133; G08G 1/0141; G08G 1/0175
See application file for complete search history.

(56) References Cited

U.S. PATENT DOCUMENTS 5,699,056 A * 12/1997 Yoshida ..... G08G 1/096716 340/995.13
5,999,877 A * 12/1999 Takahashi ..... G06V 20/54 340/916
7,460,691 B2 * 12/2008 Ng ..... H04N 7/18 73/488
7,580,547 B2 * 8/2009 Benhammou ..... G06T 7/80 382/104
8,508,386 B2 * 8/2013 Yamada ..... G08G 1/095 340/901

(Continued)

FOREIGN PATENT DOCUMENTS

JP 2016-201059 12/2016

*Primary Examiner* — Luis A Martinez Borrero
(74) *Attorney, Agent, or Firm* — Amin, Turocy & Watson, LLP

(57) ABSTRACT

A traffic flow estimation apparatus includes: a vehicle number detector which detects a number of preceding vehicles in front of the traffic flow estimation apparatus and; a traffic flow estimator which estimates a traffic flow from the number of preceding vehicles, and the traffic flow estimator includes: an acquisition unit which acquires a time series of the number of preceding vehicles in a first predetermined period as a vehicle number time series; an evaluation index calculation unit which calculates an evaluation index of the vehicle number time series in the first predetermined period; a congestion state determination unit which determines the traffic flow of the preceding vehicles on the basis of the evaluation index; and a traffic flow controller which notifies a following vehicle behind the traffic flow estimation apparatus of an indication with respect to travel on the basis of the traffic flow of the preceding vehicles.

12 Claims, 17 Drawing Sheets

(56) References Cited

U.S. PATENT DOCUMENTS 8,892,343 B2 * 11/2014 Gupta ..... G08G 1/0116 701/423
8,930,123 B2 * 1/2015 Srivastava ..... G08G 1/0112 701/119
9,058,744 B2 * 6/2015 Huang ..... G06V 20/54
9,171,463 B2 * 10/2015 Koshizen ..... G01C 21/3691
10,042,055 B2 * 8/2018 Zhao ..... G08G 1/0141
10,380,885 B2 * 8/2019 Biehle ..... G08G 1/096791
10,540,891 B2 * 1/2020 Ashida ..... G08G 1/09
10,692,367 B2 * 6/2020 Nguyen ..... G08G 1/08
10,963,705 B2 * 3/2021 Huang ..... G06V 10/82
11,260,858 B2 * 3/2022 Koshizen ..... G08G 1/0145
2007/0027583 A1 * 2/2007 Tamir ..... G09B 19/167 701/1
2009/0048750 A1 * 2/2009 Breed ..... G08G 1/161 701/70
2011/0090094 A1 * 4/2011 Yamada ..... G08G 1/095 340/905
2011/0095906 A1 * 4/2011 Stahlin ..... G08G 1/095 340/905
2012/0130625 A1 * 5/2012 Srivastava ..... G08G 1/0133 701/119
2013/0041574 A1 * 2/2013 Koshizen ..... G08G 1/0133 701/118
2013/0103296 A1 * 4/2013 Koshizen ..... G08G 1/0112 701/119
2014/0226567 A1 * 8/2014 Sakata ..... H04W 4/06 370/328
2015/0178247 A1 * 6/2015 Kinoshita ..... G01V 99/00 702/179
2017/0309171 A1 * 10/2017 Zhao ..... G08G 1/0112
2019/0012551 A1 * 1/2019 Fung ..... G06V 10/56
2020/0042799 A1 * 2/2020 Huang ..... G06N 3/0454
2020/0223433 A1 * 7/2020 Koshizen ..... G08G 1/0112
2021/0264175 A1 * 8/2021 Zhang ..... G06V 20/58

* cited by examiner

TRAFFIC FLOW ESTIMATION APPARATUS, TRAFFIC FLOW ESTIMATION METHOD, AND STORAGE MEDIUM

CROSS-REFERENCE TO RELATED APPLICATION

Priority is claimed on Japanese Patent Application No. 2019-154573, filed Aug. 27, 2019, the content of which is incorporated herein by reference.

BACKGROUND OF THE INVENTION

Field of the Invention

The present invention relates to a traffic flow estimation apparatus, a traffic flow estimation method, and a storage medium.

Description of Related Art

A technique of detecting an indication of occurrence of traffic congestion on the basis of change in a current position and an acceleration of a vehicle is known (refer to Japanese Unexamined Patent Application, First Publication No. 2016-201059, for example).

SUMMARY OF THE INVENTION

However, in this conventional technique, an indication of traffic congestion is detected using a position of a vehicle measured using a global navigation satellite system (GNSS). Accordingly, in the conventional technique, a measurement error generated when a position of a vehicle is measured tends to affect the traffic congestion prediction accuracy and a delay occurring when positional information is transmitted tends to affect the traffic congestion prediction accuracy. Consequently, there are cases in which a traffic flow cannot be estimated with high accuracy in the conventional technique.

An object of embodiments according to the present invention devised in view of the aforementioned problems is to provide a traffic flow estimation apparatus, a traffic flow estimation method, and a storage medium which can estimate a traffic flow with high accuracy.

To accomplish the aforementioned object, the present invention employs the following aspects.

(1) A traffic flow estimation apparatus according to one aspect of the present invention is a traffic flow estimation apparatus including: a vehicle number detector configured to detect a number of preceding vehicles in front of the traffic flow estimation apparatus; and a traffic flow estimator configured to estimate a traffic flow from the number of preceding vehicles, wherein the traffic flow estimator includes: an acquisition unit configured to acquire a time series of the number of preceding vehicles in a first predetermined period as a vehicle number time series; an evaluation index calculation unit configured to calculate an evaluation index of the vehicle number time series in the first predetermined period; a congestion state determination unit configured to determine the traffic flow of the preceding vehicles on the basis of the evaluation index; and a traffic flow controller configured to notify a following vehicle behind the traffic flow estimation apparatus of an indication with respect to travel on the basis of the traffic flow of the preceding vehicles.

(2) In the aspect (1), the evaluation index may be calculated using a plurality of regression coefficients of change in the number of preceding vehicles detected with respect to time in a second predetermined period longer than the first predetermined period.

(3) In the aspect (2), the evaluation index may be calculated as an average value of the plurality of regression coefficients.

(4) In the aspects (1) to (3), the traffic flow estimator may determine that the traffic flow is a congestion start state and cause the traffic flow controller to transmit an inter-vehicle time control instruction for increasing an inter-vehicle time to the following vehicle as a notification related to curbing of congestion when the evaluation index is equal to or greater than a first threshold value.

(5) In the aspect (4), the traffic flow estimator may determine that the traffic flow is a congestion threshold state and cause the traffic flow controller to transmit the inter-vehicle time control instruction for decreasing the inter-vehicle time to the following vehicle as a notification related to curbing of congestion when the evaluation index is equal to or greater than a second threshold value equal to or less than the first threshold value.

(6) In the aspect (4), the traffic flow estimator may transmit the inter-vehicle time control instruction for decreasing the inter-vehicle time to the following vehicle in at least one of a case in which the evaluation index decreases as compared to the congestion start state and a congestion length that is a length of congestion in the congestion start state does not change and a case in which the evaluation index increases as compared to the congestion start state and the congestion length extends as compared to the congestion start state after the congestion start state is determined.

(7) In the aspect (4), the traffic flow estimator may transmit the inter-vehicle time control instruction for increasing the inter-vehicle time to the following vehicle in at least one of a case in which the evaluation index increases as compared to the congestion start state and a congestion length that is a length of congestion in the congestion start state does not change and a case in which the evaluation index decreases as compared to the congestion start state and the congestion length that is the length of the congestion extends as compared to the congestion start state after the congestion start state is determined.

(8) In the aspects (1) to (7), the vehicle number detector may further include an imaging unit configured to capture a forward view image of the traffic flow estimation apparatus and an image processor configured to perform image processing on the captured image, and detect a number of preceding vehicles included in the captured image as a number of vehicles.

(9) In the aspect (8), the vehicle number detector may include a learning model learnt by a learning data set, wherein the learning model may be a neural network model, the learning data set may be data in which input data that is image information photographed by a vehicle is associated with output data that is positional coordinates of a vehicle photographed in the image information, the learning model may estimate positional coordinates of a preceding vehicle photographed in a forward view image by inputting the forward view image, and the vehicle number detector may detect a number of vehicle on the basis of the estimated positional coordinates.

(10) In the aspect (9), the image processor may obtain positional coordinates of a bounding box that is a bounded region of a vehicle using the learning model for the captured image.

(11) A traffic flow estimation method according to one aspect of the present invention is a traffic flow estimation method in a traffic flow estimation apparatus, the method including: detecting a number of preceding vehicles in front of the traffic flow estimation apparatus; estimating a traffic flow from the number of preceding vehicles; acquiring a time series of the number of preceding vehicles in a first predetermined period as a vehicle number time series; calculating an evaluation index of the vehicle number time series in the first predetermined period; determining a congestion state of the preceding vehicles on the basis of the evaluation index; and notifying a following vehicle behind the traffic flow estimation apparatus of an indication with respect to travel on the basis of the congestion state of the preceding vehicles.

(12) A non-transitory computer-readable storage medium according to one aspect of the present invention stores a program causing a computer of a traffic flow estimation apparatus to: detect a number of preceding vehicles in front of the traffic flow estimation apparatus; estimate a traffic flow from the number of preceding vehicles; acquire a time series of the number of preceding vehicles in a first predetermined period as a vehicle number time series; calculate an evaluation index of the vehicle number time series in the first predetermined period; determine a congestion state of the preceding vehicles on the basis of the evaluation index; and notify a following vehicle behind the traffic flow estimation apparatus of an indication with respect to travel on the basis of the congestion state of the preceding vehicles.

According to the aspect (1), (11) or (12), it is possible to estimate a traffic flow with high accuracy because a traffic flow is estimated on the basis of an evaluation index of a time series of the number of vehicles.

According to the aspects (2) and (3), it is possible to appropriately calculate an evaluation index necessary for traffic flow estimation.

According to the aspect (4), it is possible to curb congestion by transmitting an inter-vehicle time control instruction for increasing an inter-vehicle time to a following vehicle when it is determined that a traffic flow is a congestion start state.

According to the aspect (5), it is possible to curb congestion by transmitting an inter-vehicle time control instruction for decreasing an inter-vehicle time to a following vehicle when it is determined that a traffic flow is a congestion threshold state.

According to the aspects (6) and (7), it is possible to curb congestion by transmitting an inter-vehicle time control instruction for decreasing or increasing an inter-vehicle time to a following vehicle even when a traffic flow has changed from a congestion start state.

According to the aspects (8) to (10), it is possible to appropriately detect the number of vehicles on the basis of a captured image and a learning model.

DETAILED DESCRIPTION OF THE INVENTION

Figure 1:
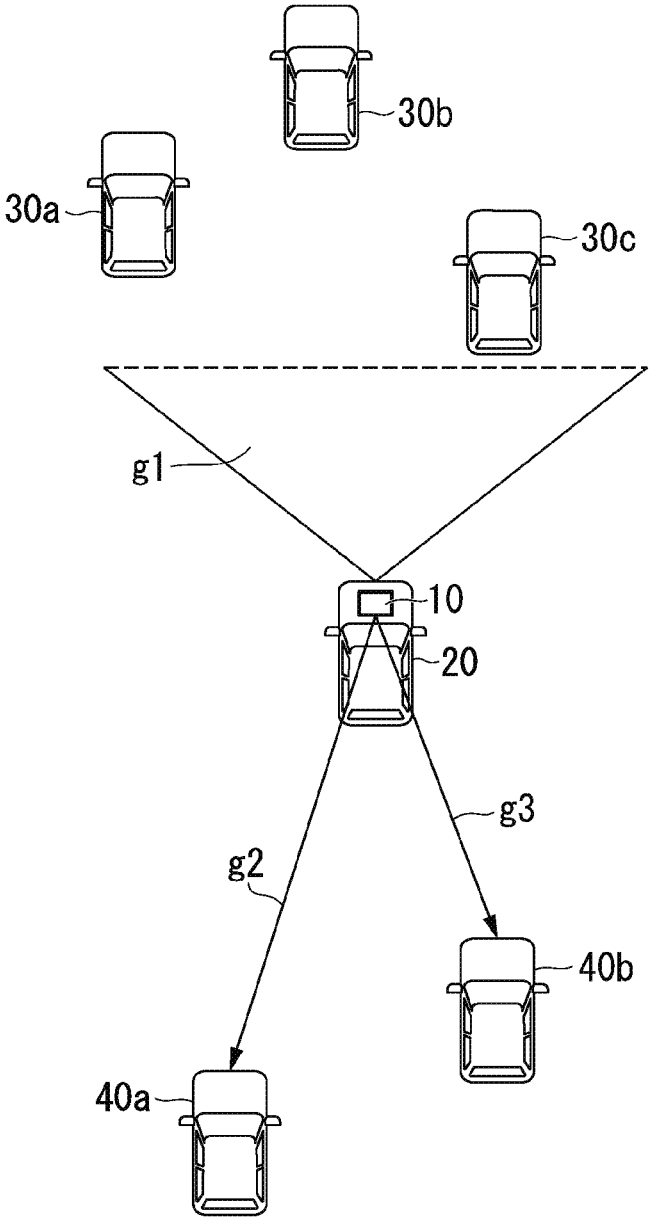
FIG. 1 is a diagram showing an overview of an operation of a traffic flow estimation apparatus according to an embodiment.

Hereinafter, embodiments of the present invention will be described with reference to the drawings. Since it is assumed that each member has a recognizable size in the drawings used in the following description, the scale of each member has been appropriately changed. In the following description, a vehicle may be, for example, a two-wheeled, threewheeled, four-wheeled vehicle or the like. A driving source of these vehicles includes an internal combustion engine such as a diesel engine or a gasoline engine, a motor, or a combination thereof. The motor operates using power generated by a generator connected to the internal combustion engine or power discharged from a secondary battery or a fuel battery.

FIG. 1 is a diagram showing an overview of an operation of a traffic flow estimation apparatus 10 according to the present embodiment. As shown in FIG. 1, the traffic flow estimation apparatus 10 is mounted in a vehicle 20. The vehicle 20 detects presence or absence and the number of vehicles 30*a* to 30*c* traveling in front of the vehicle 20 in a travel direction of the vehicle 20 while traveling on a road. Reference sign g1 represents an example of an angle of view imaged when the traffic flow estimation apparatus 10 detects a preceding vehicle. In the present embodiment, it is assumed that the vehicle 20 is traveling in a plurality of lanes (multiple lanes). A method of detecting presence or absence and the number of vehicles will be described later.

The traffic flow estimation apparatus 10 estimates a traffic flow on the basis of a vehicle detection result. A traffic flow is a state in which preceding traveling vehicles gather (gathering state). In the present embodiment, three stages of congestion threshold, congestion start and congestion extension are handled as vehicle gathering states. The congestion threshold is a state in which occurrence of congestion is predicted although it has not yet occurred. A congestion indication is defined as an initial stage of the congestion threshold. The congestion start is a state in which congestion has started. The congestion extension is a state in which congestion starts and continues. The traffic flow estimation apparatus 10 outputs an instruction to the vehicle 20 such that traveling of the vehicle 20 in which the traffic flow estimation apparatus 10 is mounted is controlled according to an estimation result. The traffic flow estimation apparatus 10 transmits an inter-vehicle time control instruction with respect to travel to vehicles 40*a* and 40*b* following the vehicle 20 in a travel direction of the vehicle 20 according to an estimation result. Reference signs g2 and g3 represent an inter-vehicle time control instruction transmitted from the traffic flow estimation apparatus 10 to following vehicles. A traffic flow estimation method, a control instruction of a host vehicle, and an inter-vehicle time control instruction to a following vehicle will be described later.

<Configuration and Operation of Traffic Flow Estimation Apparatus 10>

Figure 2:
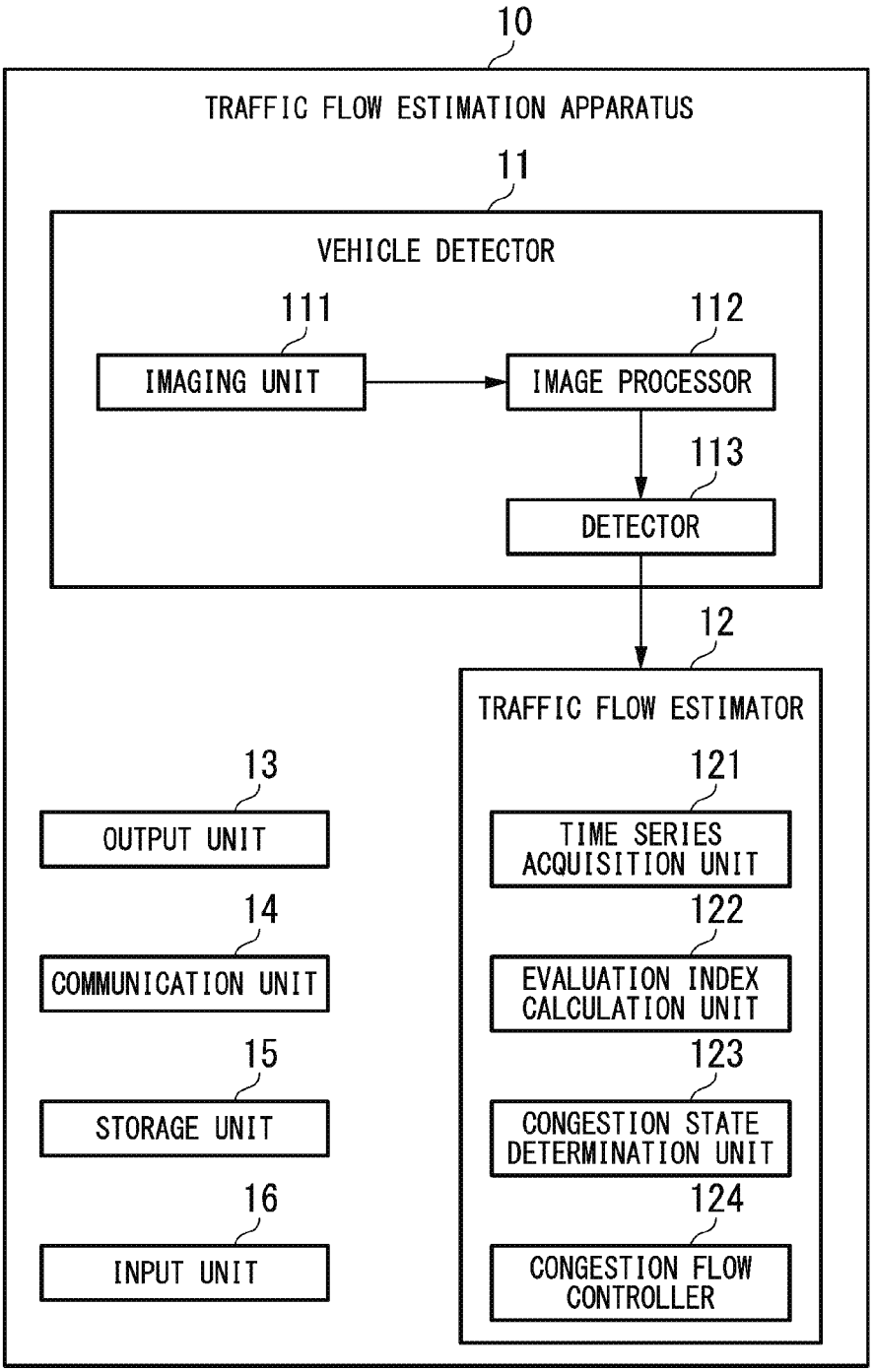
FIG. 2 is a block diagram showing a configuration example of the traffic flow estimation apparatus according to the embodiment.

FIG. 2 is a block diagram showing a configuration example of the traffic flow estimation apparatus 10 according to the present embodiment. As shown in FIG. 2, the traffic flow estimation apparatus 10 includes a vehicle detector 11, a traffic flow estimator 12, an output unit 13, a communication unit 14, and a storage unit 15. The vehicle detector 11 includes an imaging unit 111, an image processor 112, and a detector 113. The traffic flow estimator 12 includes a time series acquisition unit 121, an evaluation index calculation unit 122, a congestion state determination unit 123, and a traffic flow controller 124. The traffic flow estimation apparatus 10 may include an operator 16 which detects a result of an operation of a user.

The vehicle detector 11 captures a forward view image of the vehicle 20 (FIG. 1) in which the traffic flow estimation apparatus 10 is mounted and detects presence or absence and the number of vehicles on the basis of the captured image. The vehicle detector 11 outputs the detected detection result to the traffic flow estimator 12.

The imaging unit 111 may be, for example, a charge coupled device (CCD) imaging device, a complementary metal oxide semiconductor (CMOS) imaging device, or the like. The imaging unit 111 captures a forward view image of the vehicle 20 in which the traffic flow estimation apparatus 10 is mounted and outputs the captured image to the image processor 112. The imaging unit 111 may be provided inside the vehicle 20 (FIG. 1) or provided outside the vehicle 20.

The image processor 112 performs predetermined image processing on an image output from the imaging unit 111. The predetermined image processing may include, for example, at least one of binarization, edge detection, feature quantity extraction, clustering processing, and the like. The image processor 112 extracts a bounded region of a vehicle (hereinafter referred to as a bounding box BB) from a captured image using inference model data stored in the storage unit 15. The image processor 112 outputs processing results to the detector 113. The processing results may include, for example, coordinates of the bounding box BB.

The detector 113 detects the presence or absence and the number of vehicles on the basis of the processing result output from the image processor 112. The detector 113 detects the number of bounding boxes BB (the number of vehicles) for each first predetermined period T1 on the basis of coordinates of the bounding boxes BB. The detector 113 outputs the number of detected vehicles that is a detected detection result to the traffic flow estimator 12.

The traffic flow estimator 12 estimates a traffic flow on the basis of the detection result output from the detector 113 of the vehicle detector 11. The traffic flow estimator 12 generates an inter-vehicle time control instruction of the host vehicle in which the traffic flow estimation apparatus 10 is mounted on the basis of an estimation result and outputs the generated inter-vehicle time control instruction to the output unit 13. The traffic flow estimator 12 generates the inter-vehicle time control instruction as a notification related to curbing of congestion for a vehicle that is traveling behind the host vehicle on the basis of the estimation result and outputs the generated inter-vehicle time control instruction to the communication unit 14.

The time series acquisition unit 121 acquires detection results output from the detector 113 as the number of vehicles in a time series (referring to as a vehicle number time series).

The evaluation index calculation unit 122 calculates regression coefficients of a vehicle number time series in a second predetermined period T2. The second predetermined period T2 is longer than the first predetermined period T1. The evaluation index calculation unit 122 calculates an average value of regression coefficients in a third predetermined period T3. The third predetermined period T3 is longer than the second predetermined period T2. The evaluation index calculation unit 122 outputs the calculated average value of regression coefficients in the third predetermined period T3 to the congestion state determination unit 123 as an evaluation index.

The congestion state determination unit 123 estimates a traffic flow of vehicles traveling in front of the host vehicle by comparing an evaluation index (an average value of regression coefficients in a fourth predetermined time T4) output from the evaluation index calculation unit 122 with threshold values (a first threshold value and a second threshold value) stored in the storage unit 15 and outputs information representing the estimated traffic flow to the traffic flow controller 124. A method of estimating a traffic flow will be described later.

The traffic flow controller 124 generates an inter-vehicle time control instruction with respect to the host vehicle in which the traffic flow estimation apparatus 10 is mounted on the basis of the information representing the traffic flow output from the congestion state determination unit 123 and outputs the generated inter-vehicle time control instruction to the output unit 13. The traffic flow controller 124 generates an inter-vehicle time control instruction with respect to a vehicle traveling behind the host vehicle on the basis of the traffic flow output from the congestion state determination unit 123 and outputs the generated inter-vehicle time control instruction to the communication unit 14.

The output unit 13 outputs the inter-vehicle time control instruction output from the traffic flow estimator 12 to a controller (e.g., an engine control unit (ECU)) of the vehicle 20 in which the traffic flow estimation apparatus 10 is mounted. The controller of the vehicle 20 in which the traffic flow estimation apparatus 10 is mounted is connected to the output unit 13 through an on-board network such as a CAN, for example.

The communication unit 14 transmits the inter-vehicle time control instruction output from the traffic flow estimator 12 to a vehicle that is traveling behind the vehicle 20 in which the traffic flow estimation apparatus 10 is mounted. The vehicle that is traveling behind the vehicle 20 in which the traffic flow estimation apparatus 10 is mounted is connected to the communication unit 14 through a network.

The storage unit 15 stores the first threshold value and the second threshold value. The storage unit 15 stores the first predetermined period T1, the second predetermined period T2, the third predetermined period T3, and the fourth predetermined period T4. The storage unit 15 stores the inference model data. For example, the inference model data may be information (a program or a data structure) in which an inference model MDL for extracting a bounding box BB from an image is defined. The storage unit 15 stores information such as a program and threshold values used by the vehicle detector 11 for processing, and information such as a program and threshold values used by the traffic flow estimator 12 for processing. The inference model data may be stored in the traffic flow estimator 12. Alternatively, the inference model data may be stored in a server or the like via a network.

<Inference Model Data>

Figure 3:
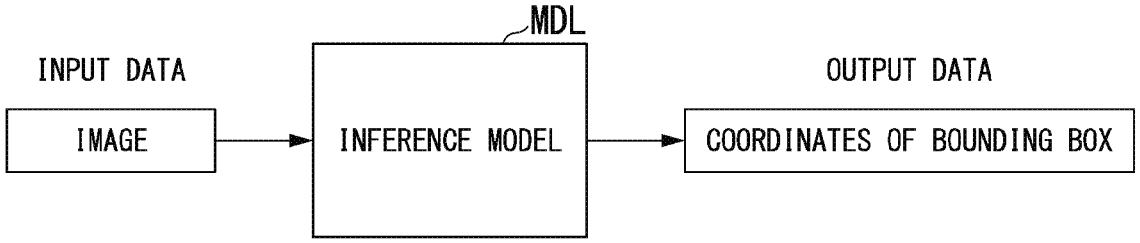
FIG. 3 is a diagram showing an example of an inference model MDL.

Next, the inference model data will be described. FIG. 3 is a diagram showing an example of the inference model MDL. As shown in FIG. 3, the inference model MDL is a model trained to output coordinates of a bounding box BB in an image when the image is input thereto.

The inference model MDL may be realized using a deep neural network(s) (DNN) such as a convolutional neural network (CNN), for example. The inference model MDL is not limited to a DNN and may be realized by other models such as logistic regress, a support vector machine (SVM), a k-nearest neighbor algorithm (k-NN), a decision tree, a Naive Bayes classifier, and a random forest.

When the inference model MDL is realized by a DNN such as a CNN, the inference model data may include, for example, combination information representing how neurons (units or nodes) included in an input layer constituting each DNN included in the inference model MDL, one or more hidden layers (middle layers), and an output layer are combined, weight information representing the number of combination coefficients assigned to data input/output between the combined neurons, and the like.

The combination information may include, for example, information that designates the number of neurons included in each layer and a type of a neuron of a combination destination of each neuron, and information such as an activation function for realizing each neuron and gates provided between neurons of hidden layers. The activation function for realizing a neuron may be, for example, a function of switching operations in response to input code (a rectified linear unit (ReLU) function, exponential linear units (ELU) function, or the like), a Sigmoid function, a step function or a hyperbolic tangent function, or an identity function. For example, a gate selectively passes data transferred between neurons or weights the data in response to a value (e.g., 1 or 0) returned by the activation function. The combination coefficients are parameters of the activation function and include, for example, a weight assigned to output data when data is output from a neuron of a certain layer to a neuron of a deeper layer in a hidden layer of a neural network. The combination coefficients may include a unique bias component of each layer, and the like.

The inference model data stored in the storage unit 15 includes a learning model learnt by a learning data set. The learning model is a neural network model. In the learning data set, input data that is image information photographed by a vehicle is associated with output data that is positional coordinates of a vehicle photographed in the image information. The learning model estimates positional coordinates of a preceding vehicle captured in a forward view image by inputting the forward view image. The detector 113 detects the number of estimated positional coordinates as the number of vehicles.

<Processing Performed by Vehicle Detector 11>

Figure 4:
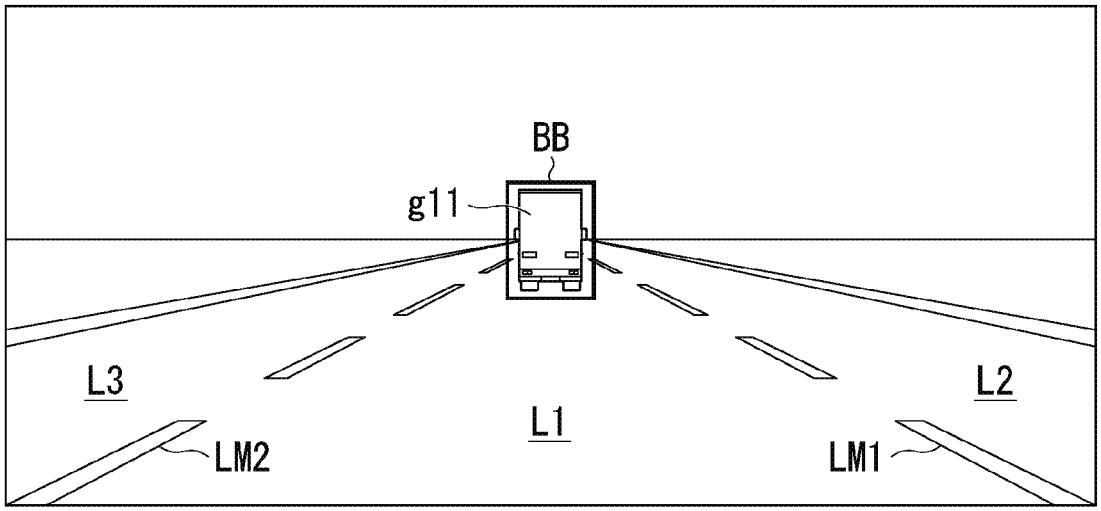
FIG. 4 is a diagram showing an example of an image extracted by a bounding box BB according to the embodiment.

Next, processing performed by the vehicle detector 11 will be described. FIG. 4 is a diagram showing an example of an image from which a bounding box BB according to the present embodiment has been extracted. Reference sign L1 represents a host lane in which the host vehicle 20 (FIG. 1) is traveling. Reference sign L2 represents a neighboring lane that neighbors the host lane L1 on the right side in a travel direction. Reference sign L3 represents a neighboring lane that neighbors the host lane L1 on the left side in the travel direction. Reference sign LM1 represents lane markings for marking the host lane L1 and the neighboring lane L2 on the right side. Reference sign LM2 represents a mark line for marking the host lane L1 and the neighboring lane L3 on the left side. Reference sign g11 represents an image of a vehicle that is traveling in front of the vehicle 20 in which the traffic flow estimation apparatus 10 is mounted.

In FIG. 4, a preceding vehicle is present in front of the host vehicle 20 (FIG. 2) in the host lane L1. The image processor 112 (FIG. 2) extracts a region to the rear (side behind) of the preceding vehicle from a captured image as a bounding box BB.

Figure 5:
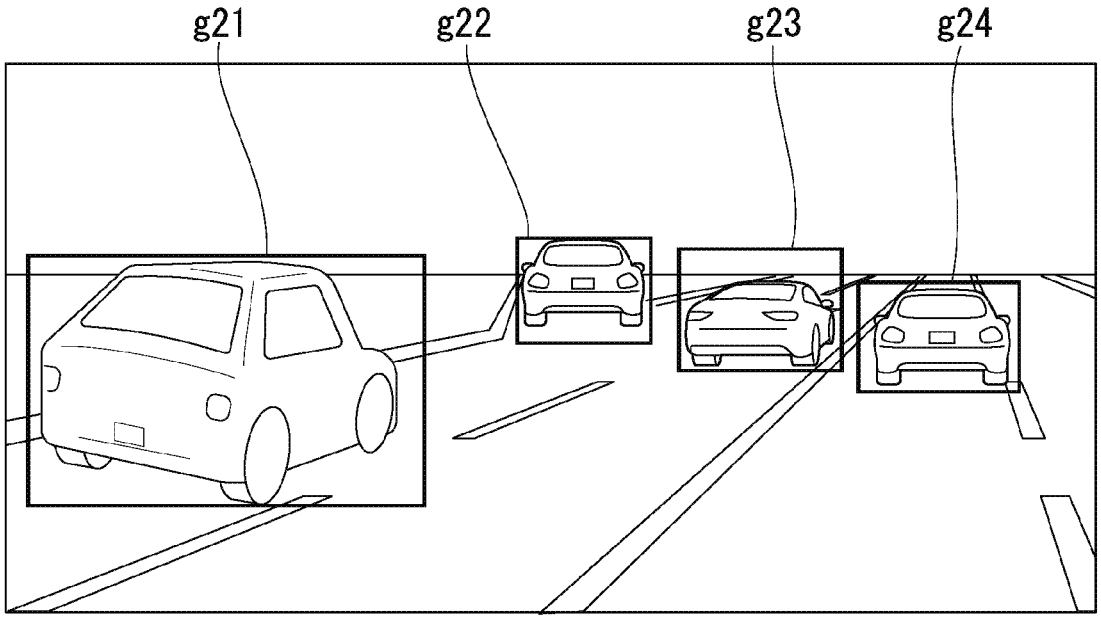
FIG. 5 is a diagram showing an example of bounding boxes BB extracted when a plurality of vehicles in front of a host vehicle in a plurality of lanes (traffic lanes) are imaged.

FIG. 5 is a diagram showing an example of bounding boxes BB extracted when a plurality of vehicles in front of the host vehicle 20 are imaged in a plurality of lanes (traffic lanes). In FIG. 5, reference signs g21 to g24 are bounding boxes BB. The detector 113 detects the number of vehicles by counting the number of bounding boxes BB. A case in which the number of vehicles is 0 is a state in which there are no vehicles traveling in front of the vehicle 20 in which the traffic flow estimation apparatus 10.

<State of Vehicle>

Figure 6:
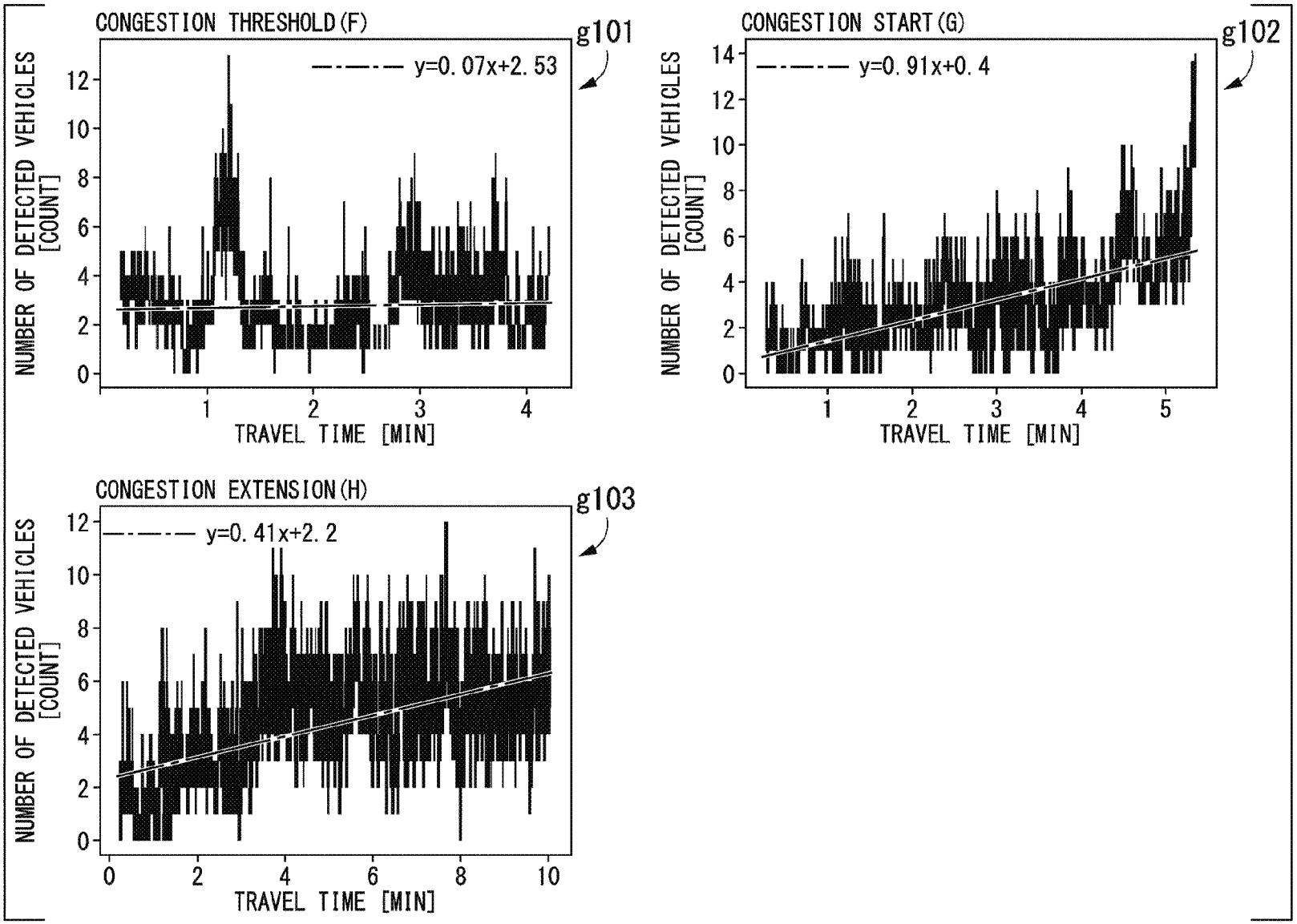
FIG. 6 is a diagram showing the number of detected vehicles with respect to a travel time.

Next, a state of a vehicle will be described. FIG. 6 is a diagram showing the number of detected vehicles with respect to a travel time. In FIG. 6, a diagram of a region indicated by reference sign g101 shows the number of detected vehicles with respect to a travel time at a vehicle state of congestion threshold (F). A diagram of a region indicated by reference sign g102 shows the number of detected vehicles with respect to a travel time in a vehicle state of congestion start (G). A diagram of a region indicated by reference sign g103 shows the number of detected vehicles with respect to a travel time in a vehicle state of congestion extension (H). In FIG. 6, the horizontal axis represents a travel time [min] and the vertical axis represents the number of detected vehicles [count]. FIG. 6 shows simulation results. The number of detected vehicles is a result obtained by counting the number of bounding boxes BB.

In reference sign g101 of FIG. 6, a result of a first approximation of the number of detected vehicles (y) with respect to a travel time (x) was y=0.07x+2.53.

In reference sign g102, a result of a first approximation of the number of detected vehicles (y) with respect to the travel time (x) was y=0.91x+0.4. In reference sign g103, a result of a first approximation of the number of detected vehicles (y) with respect to the travel time (x) was y=0.41x+2.2.

A regression coefficient may be calculated by the least squares method, for example.

Figure 7:
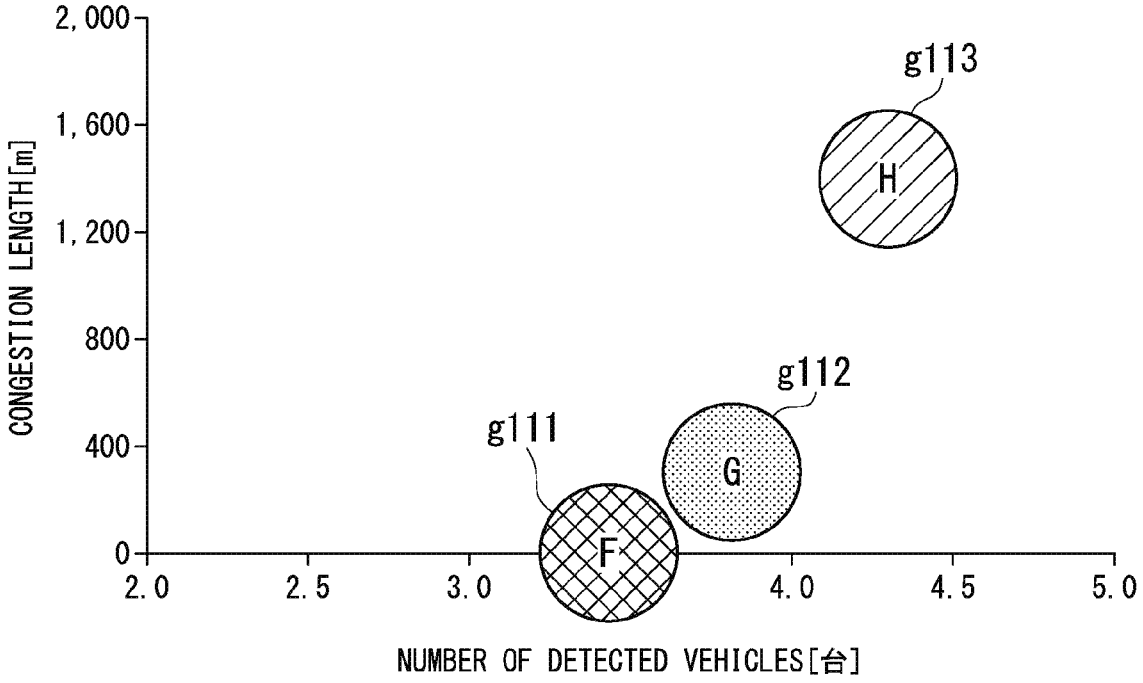
FIG. 7 shows a congestion length [m] with respect to the number of detected vehicles [count] at a congestion threshold (F), a congestion start (G), and a congestion extension (H) of FIG. 6.

FIG. 7 shows a congestion length [m] with respect to the number of detected vehicles [count] at a congestion threshold F, congestion start G, and congestion extension H of FIG. 6. Reference sign gill is congestion threshold (F), reference sign g112 is congestion start (G), and reference sign g113 is congestion extension (H). A congestion length is a length over which vehicles at a predetermined speed or lower are present at predetermined intervals on a road.

As shown in FIG. 7, in a relationship between the number of detected vehicles and a congestion length, both the number of detected vehicles and the congestion length increase in transition from congestion threshold (F) to congestion start (G) and transition from congestion start (G) to congestion extension (H).

Figure 8:
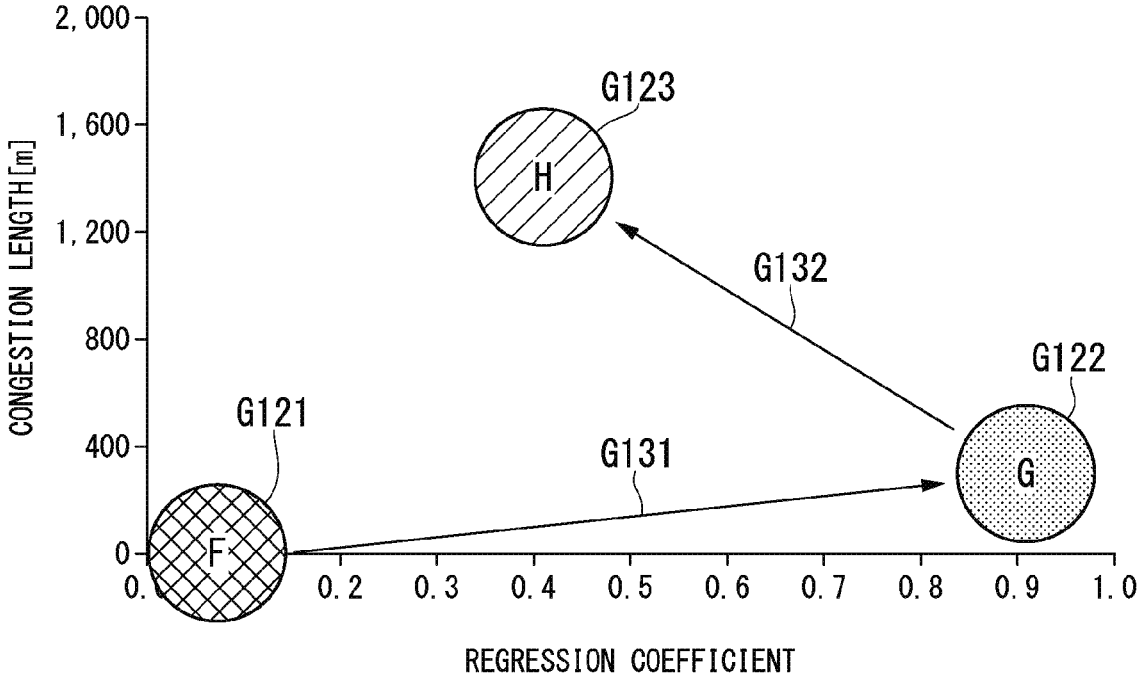
FIG. 8 shows a congestion length [m] with respect to a vehicle regression coefficient at the congestion threshold (F), congestion start (G), and congestion extension (H) of FIG. 6.

FIG. 8 shows a congestion length [m] with respect to a vehicle regression coefficient at the congestion threshold F, congestion start G, and congestion extension H of FIG. 6. Reference sign g121 is congestion threshold (F), reference sign g122 is congestion start (G), and reference sign g123 is congestion extension (H). Reference sign g131 represents transition from congestion threshold (F) to congestion start (G) and reference sign g132 represents transition from congestion start (G) to congestion extension (H).

As shown in FIG. 8, in a relationship between a regression coefficient and a congestion length, a regression coefficient value increases from 0.07 to 0.91 and a congestion length increases from about 0 m to about 300 m in transition from congestion threshold (F) to congestion start (G). In the relationship between the regression coefficient and the congestion length, the regression coefficient value decreases from 0.91 to 0.41 and the congestion length increases from about 300 m to about 1400 m in transition from congestion start (G) to congestion extension (H). In this manner, the regression coefficient greatly increases in transition from congestion threshold (F) to congestion start (G) (13 times in the example of FIG. 6) and greatly decreases in transition from congestion start (G) to congestion extension (H) (decreases by half or more in the example of FIG. 6).

Figure 9:
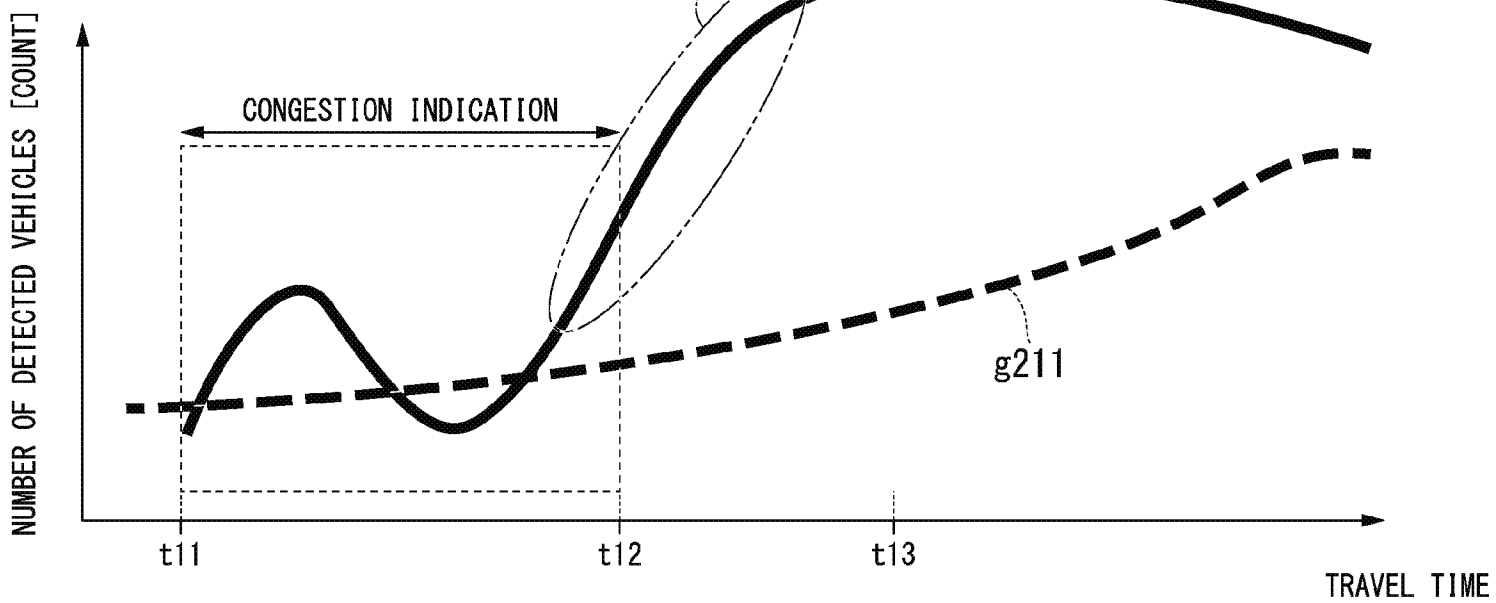
FIG. 9 is a diagram showing an example of a relationship between a travel time and the number of detected vehicles when congestion occurs during travel of a vehicle.

FIG. 9 is a diagram showing an example of a relationship between a travel time and the number of detected vehicles when congestion occurs during travel of a vehicle. In FIG. 9, the horizontal axis represents a travel time and the vertical axis represents the number of detected vehicles [count]. Reference sign g201 is an image of an example of a relationship between a travel time and the number of detected vehicles when an inter-vehicle time control instruction has not been executed for the host vehicle in which the traffic flow estimation apparatus 10 is mounted and a vehicle traveling behind the vehicle. Reference sign g211 is an image of an example of a relationship between a travel time and the number of detected vehicles when an inter-vehicle time control instruction has been executed for the host vehicle in which the traffic flow estimation apparatus 10 is mounted and the vehicle traveling behind the vehicle.

<Examination of Influence of Lane Change>

Next, results of examination about the influence of lane change will be described.

With respect to reference sign g203 of FIG. 9, a period of time t11 to time t12 is a congestion indication period. In this period, a frequency of lane change of a traveling vehicle is high as will be described later.

In a period indicated by reference sign g203, congestion starts, the speed of the traveling vehicle decreases, and as a result, lane change rarely occurs. In the period indicated by reference sign g203, an inter-vehicle distance also decreases. Congestion slowly occurs and progresses, and the length of the congestion is extending after occurrence of the congestion.

In contrast, in the present embodiment, when congestion is predicted, traveling of the host vehicle and vehicles that are traveling behind the host vehicle is controlled such that a travel speed is reduced and an inter-vehicle distance is changed such that the number of detected vehicles over a travel time is changed as represented by reference sign g211 of FIG. 9. In this manner, lane change is controlled to reduce occurrence of congestion by performing control such that the speed of a vehicle is reduced to change an inter-vehicle distance in the present embodiment.

Figure 10:
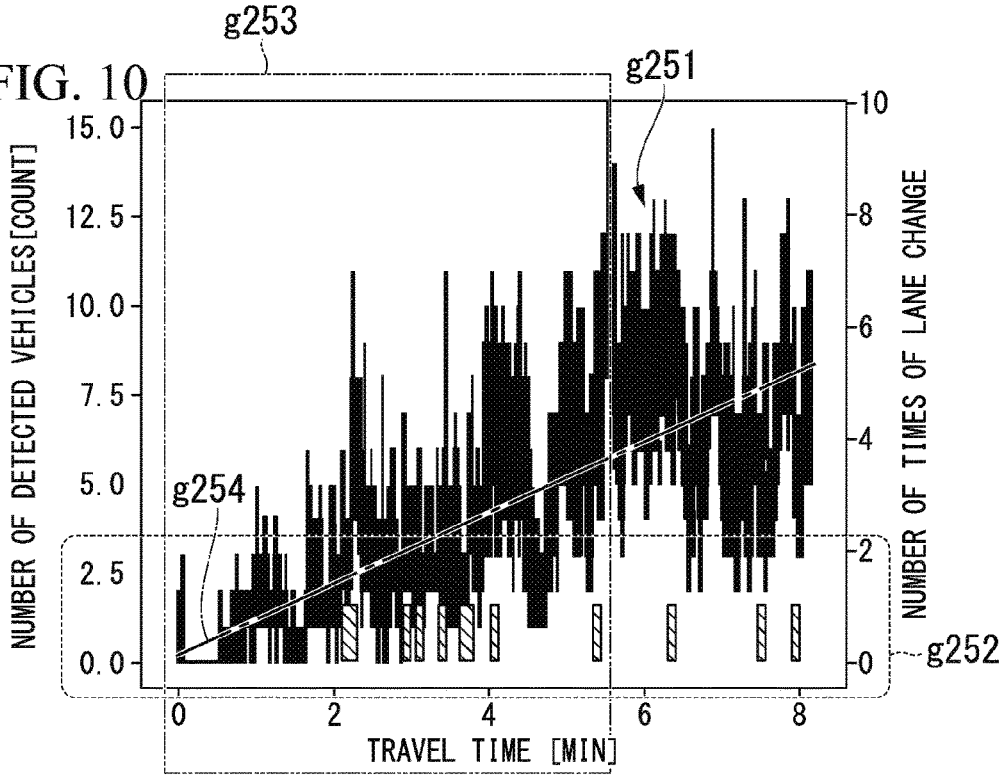
FIG. 10 is a diagram showing a relationship between the number of detected vehicles and the number of times of lane change with respect to a travel time.

FIG. 10 is a diagram showing a relationship between the number of detected vehicles and the number of times of lane change with respect to a travel time. Results of FIG. 10 are simulation results. The horizontal axis represents a travel time [min], the vertical axis with respect to reference sign g251 represents the number of detected vehicles [count], and the vertical axis with respect to reference sign g252 represents the number of times of lane change [times]. Reference sign g253 represents a travel time in which the speed of a vehicle is equal to or higher than 60 [km/h] on an expressway. Reference sign g254 represents a result of first approximation of reference sign g251.

In the example shown in FIG. 10, a frequency of lane change is high, for example, in a period of time of 2 to 4 minutes. On the contrary, a frequency of lane change in a period of time of 4 to 8 minutes is lower than that in the period of time of 2 to 4 minutes. In this simulation results, a trend of a lane change frequency increasing in a traffic flow at a congestion threshold was observed.

Figure 11:
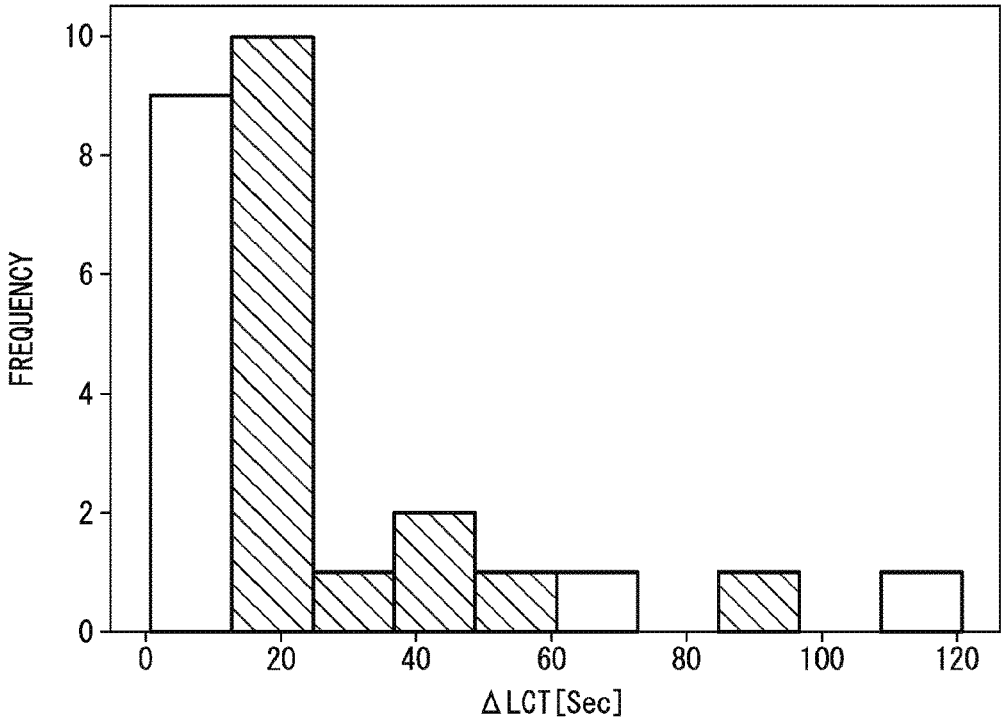
FIG. 11 is a diagram showing a frequency state of a lane change time as a histogram.

FIG. 11 is a diagram showing a frequency state of a lane change time as a histogram. The horizontal axis represents ΔLCT [sec] and the vertical axis represents [number of times]. ΔLCT is a lane change time. As shown in FIG. 11, a frequency is higher at a short lane change time than at a long lane change time. In other states, it was confirmed from simulation results that a lane change frequency increased in a traffic flow before occurrence of congestion or before congestion extension.

Next, results of classification of lane change time differences as lane change frequencies [number of times] and bounding box area fluctuation angles [DEG] will be described. A lane change time difference is a difference from lane change of a vehicle to a time when another vehicle performs lane change.

Figure 12:
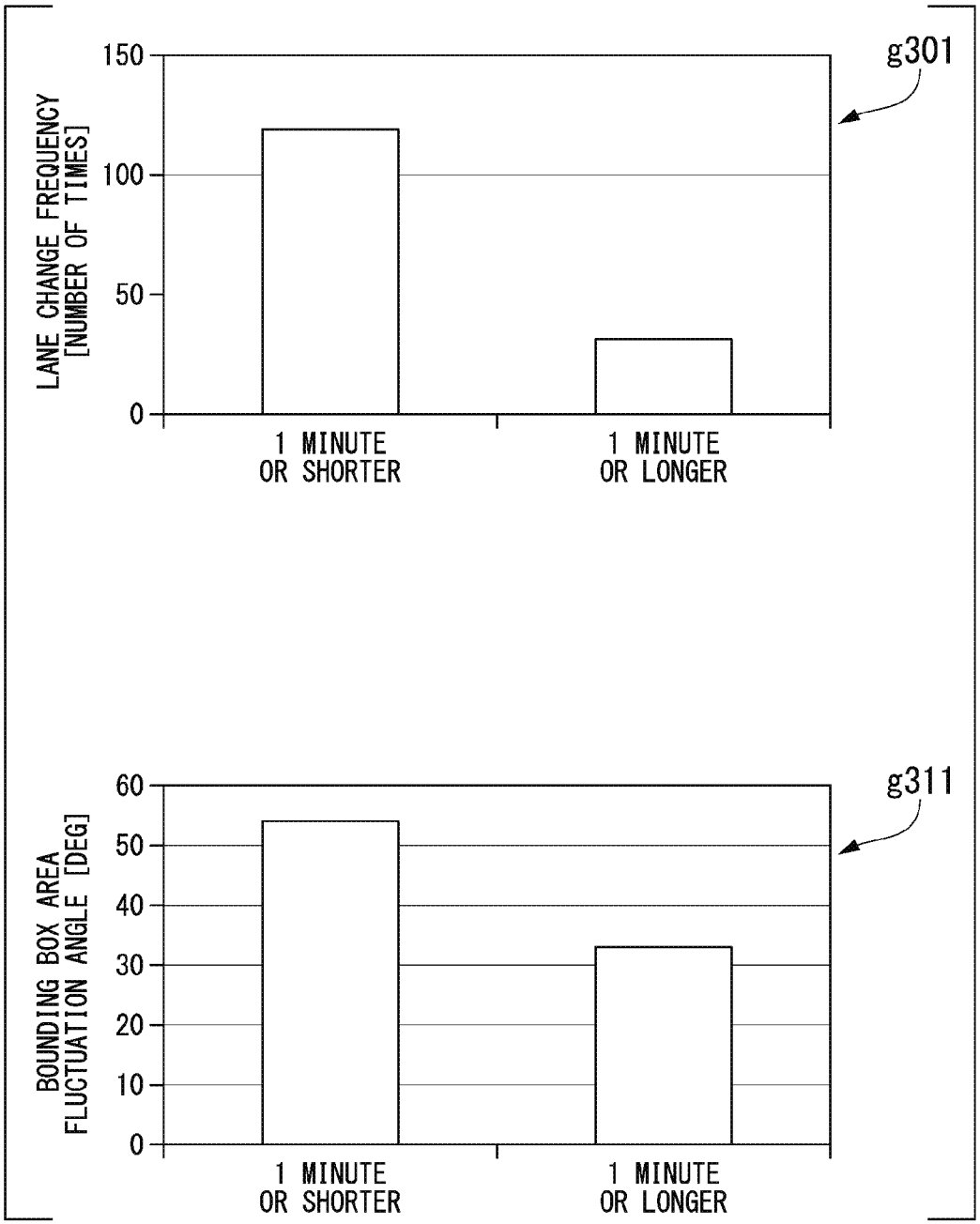
FIG. 12 is a diagram showing results of classification of lane change time differences as lane change frequencies and bounding box area fluctuation angles.

FIG. 12 is a diagram showing results of classification of lane change time differences as lane change frequencies and bounding box area fluctuation angles. Reference sign g301 represents a result of classification of lane change time differences of equal to or less than 1 minute and equal to or greater than 1 minute as lane change frequencies. The vertical axis represents a lane change frequency [number of times]. Reference sign g311 represents a result of classification of lane change time differences of equal to or less than 1 minute and equal to or greater than 1 minute as bounding box area fluctuation angles. The vertical axis represents a bounding box area fluctuation angle [DEG].

As shown by reference sign g301 of FIG. 12, when a lane change time difference is within 1 minute, a frequency of the number of times of lane change is high. At this time, a travel speed of a vehicle is relatively high and a bounding box area fluctuation angle is large.

Here, a bounding box area fluctuation angle will be described.

Figure 13:
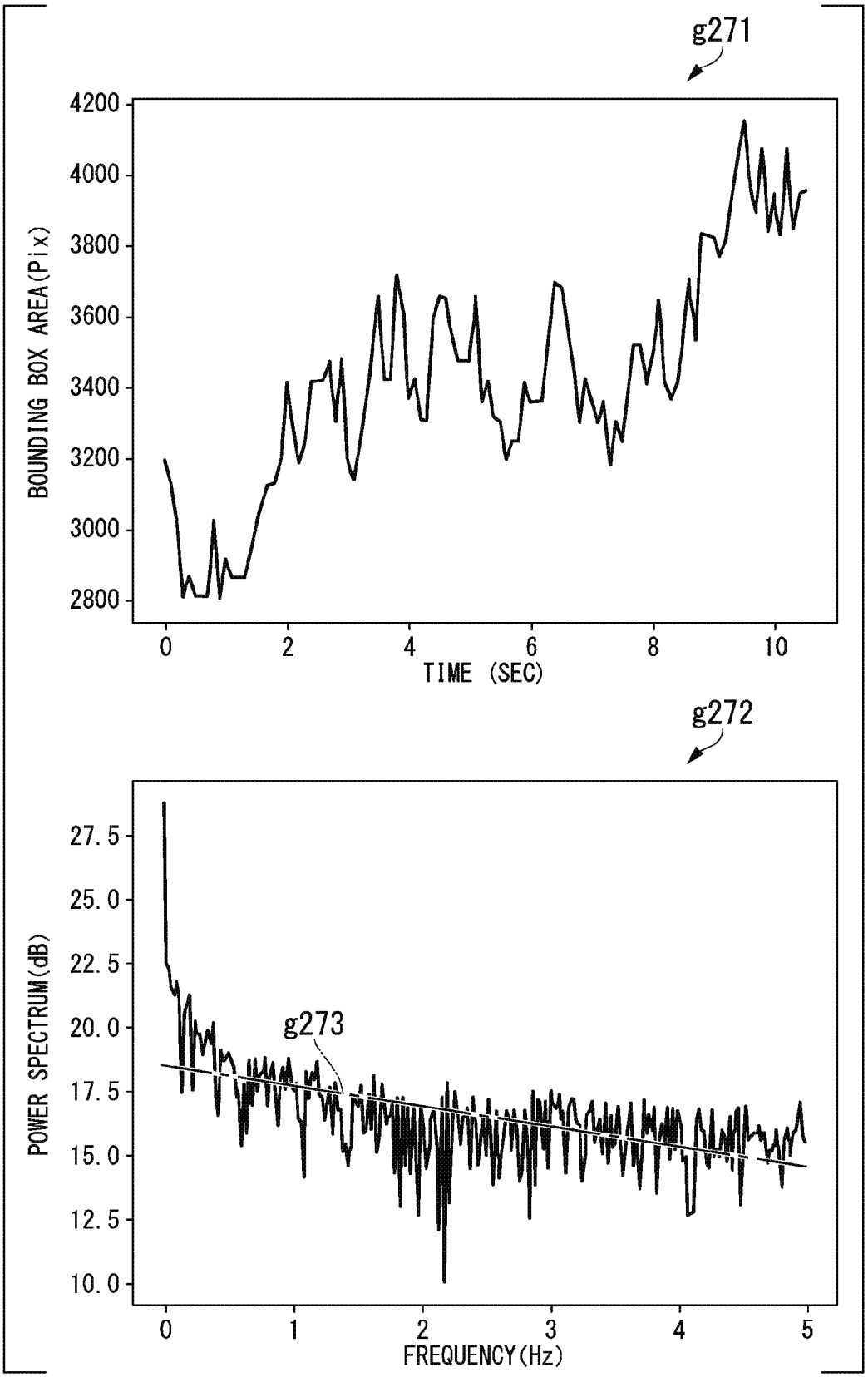
FIG. 13 is a diagram for describing a bounding box area fluctuation angle.

FIG. 13 is a diagram for describing a bounding box area fluctuation angle. In FIG. 13, a graph of a region indicated by reference sign g271 shows an example of temporal change in a bounding box area trained from a deep learning network. In the graph of the region indicated by reference sign g271, the horizontal axis represents time (sec) and the vertical axis represents a bounding box area (pixel). A graph indicated by reference sign g272 shows a power spectrum with respect to a time series of the bounding box area. In the graph indicated by reference sign g272, the horizontal axis represents a frequency (Hz) and the vertical axis represents a power spectrum (dB). Reference sign g273 represents a regression line.

For example, an angle in a chaotic pattern appears to be, for example, variation in a low frequency and calculated as 1/f (pink noise) variation in a power spectrum. Accordingly, 1/f angle can be obtained from the power spectrum and 1/f fluctuation.

Figure 14:
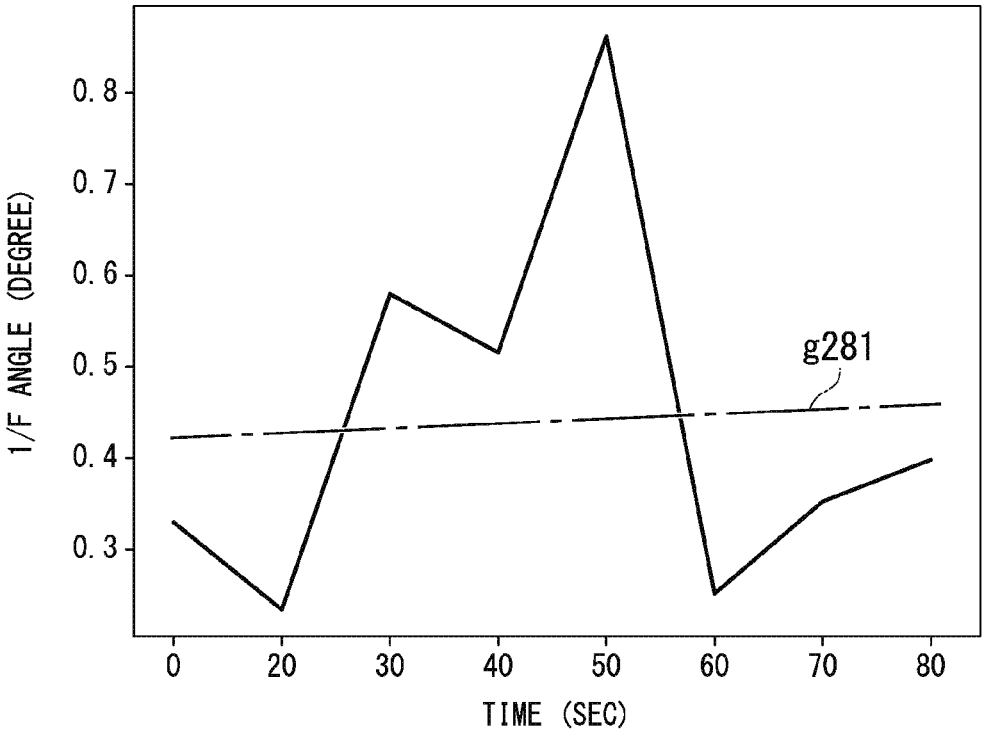
FIG. 14 is a diagram representing time variation in a 1/f angle.

FIG. 14 is a diagram representing temporal change in the 1/f angle. In FIG. 14, the horizontal axis represents time (sec) and the vertical axis represents the 1/f angle (degree). Reference sign g281 represents a regression line. The slope of this regression line is a bounding box area fluctuation angle.

Figure 15:
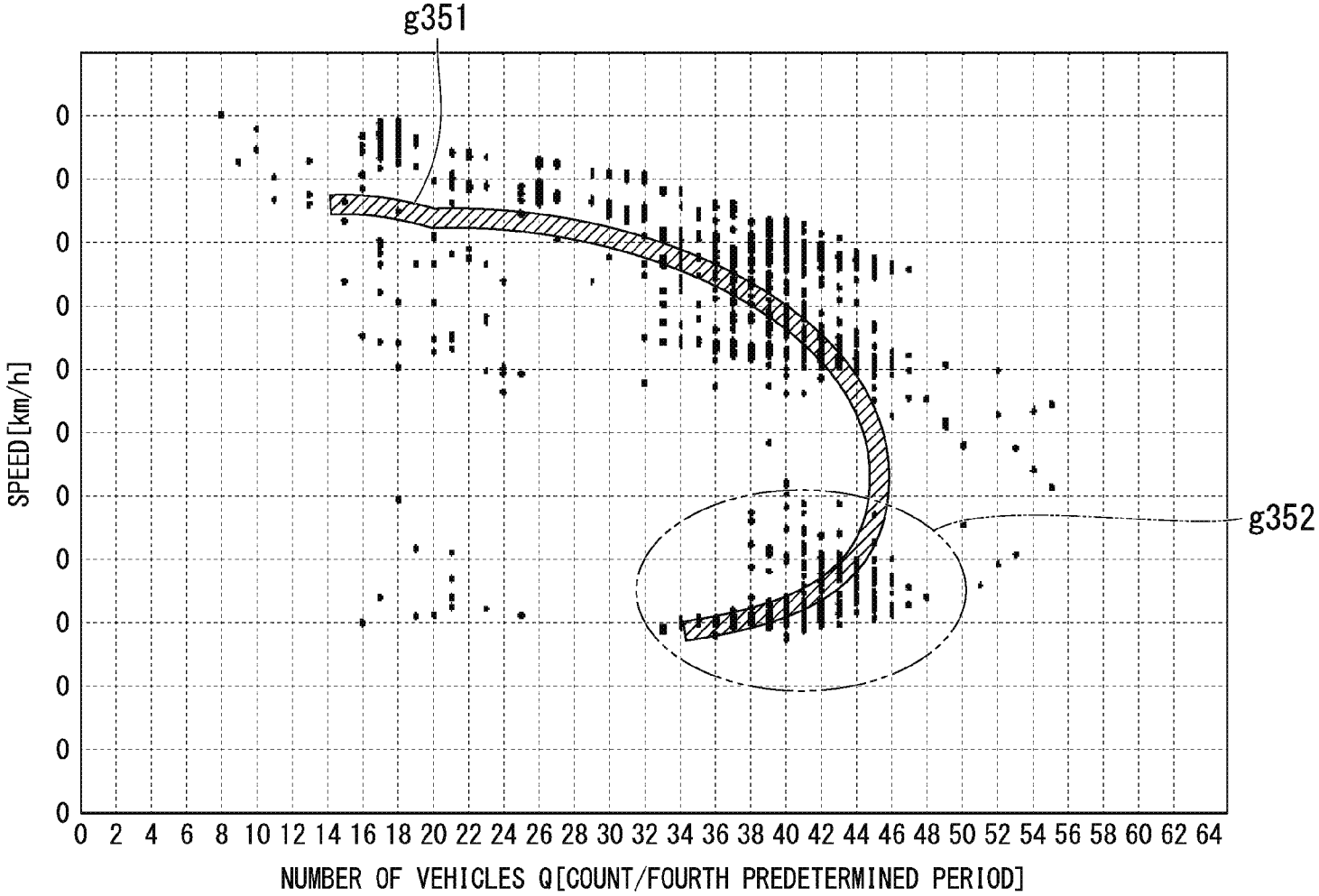
FIG. 15 is a diagram showing simulation results in multiple lanes.

Next, simulation results in multiple lanes will be described. FIG. 15 is a diagram showing simulation results in multiple lanes. In FIG. 15, the horizontal axis represents a total value of Q in the second predetermined period and the vertical axis represents a speed V [km/h] of a vehicle. Reference sign g351 is a curved line showing a trend in the number of vehicles Q and a vehicle speed V in the second predetermined period. Reference sign g352 represents occurrence of congestion to congestion extension. In the present embodiment, congestion may be a state in which a speed is equal to or less than 40 (km/h), for example, in the case of an expressway.

As in FIG. 13, in simulation results, a result of suggesting a tendency to decrease an amount of congestion (vehicle group value in a low speed region represented by reference sign g352) is obtained by decreasing speeds of following vehicles in order to reduce lane change at a congestion threshold.

<Traffic Flow Estimation Method>

Next, an example of a traffic flow estimation method will be described using FIG. 16 and FIG. 17.

Figure 16:
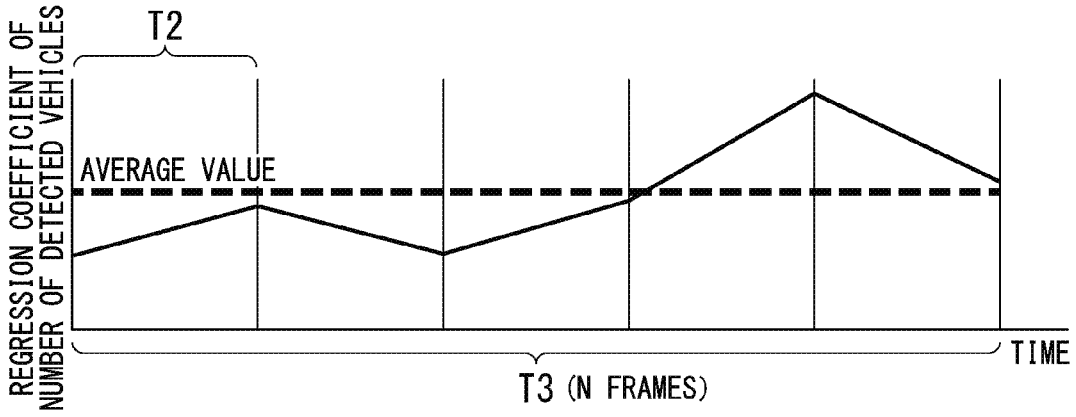
FIG. 16 is a diagram showing an example of a traffic flow estimation method according to the embodiment.

FIG. 16 is a diagram showing an example of a traffic flow estimation method according to the present embodiment. In FIG. 16, the horizontal axis represents time [sec] and the vertical axis represents a regression coefficient of the number of detected vehicles.

The time series acquisition unit 121 acquires the number of detected vehicles detected by the detector 113 as a time series. Next, the evaluation index calculation unit 122 calculates regression coefficients for the acquired number of detected values for each second predetermined period T2. Next, the evaluation index calculation unit 122 calculates an average value of regression coefficients for each third predetermined period T3. The third predetermine period T3 may be, for example, a period in which the second predetermined period T2 is n (n is an integer equal to or greater than 2) frames.

Figure 17:
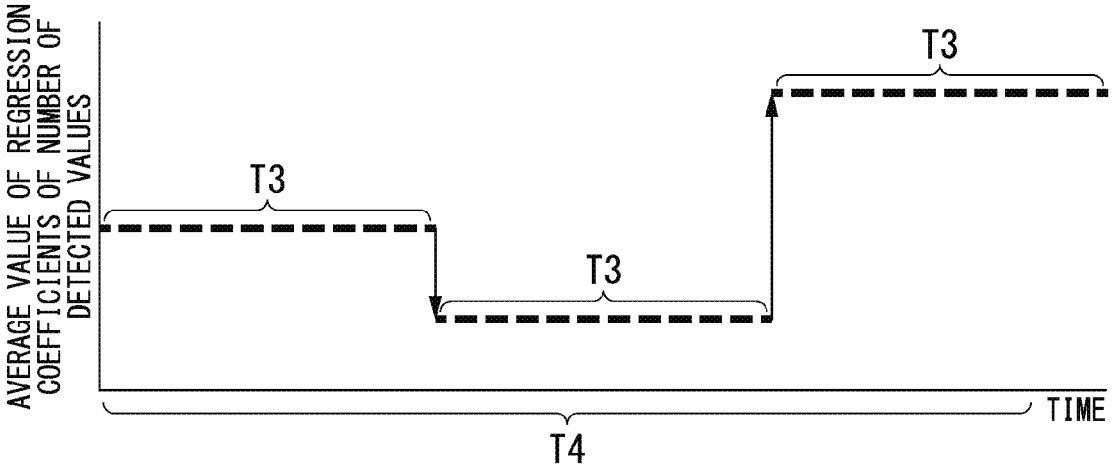
FIG. 17 is a diagram showing an example of the traffic flow estimation method according to the embodiment.

FIG. 17 is a diagram showing an example of the traffic flow estimation method according to the present embodiment. In FIG. 17, the horizontal axis represents time [sec] and the vertical axis represents an average value of regression coefficients of a number of detected vehicles.

The congestion state determination unit 123 determines whether an average value of regression coefficients for each third predetermined period T3 has continuously exceeded a threshold value for the fourth predetermined period T4. In the example shown in FIG. 15, the fourth predetermined period T4 corresponds to three of the third predetermined period T3.

The congestion state determination unit 123 classifies a traffic flow when the average value of the regression coefficients has continuously exceeded the threshold value for the fourth predetermined period T4. Specifically, the congestion state determination unit 123 determines that the traffic flow is a state between congestion start and congestion extension when the average value of the regression coefficients has continuously exceeded the first threshold value for the fourth predetermined period T4. The congestion state determination unit 123 determines that the traffic flow is a state between congestion threshold and congestion start when the average value of the regression coefficients has continuously exceeded the second threshold value for the fourth predetermined period T4. The first threshold value is greater than the second threshold value.

<Processing Procedure>

Figure 18:
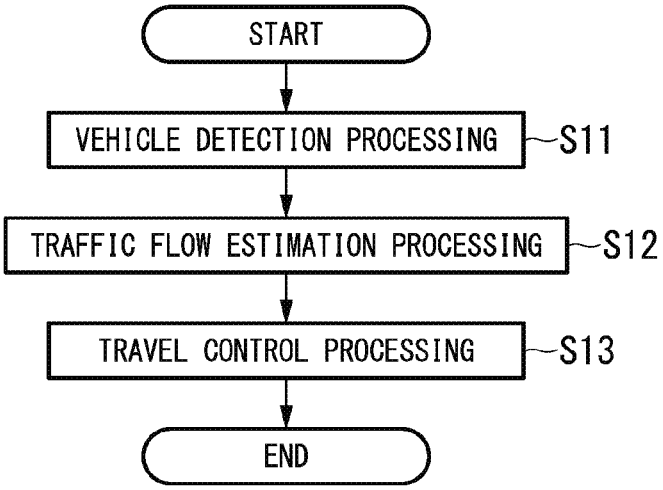
FIG. 18 is a flowchart of an example of a processing procedure performed by the traffic flow estimation apparatus according to the embodiment.

Next, an example of a processing procedure performed by the traffic flow estimation apparatus 10 will be described. FIG. 18 is a flowchart of the processing procedure performed by the traffic flow estimation apparatus 10 according to the present embodiment.

(Step S11) The vehicle detector 11 captures a forward view image of the host vehicle in which the traffic flow estimation apparatus 10 is mounted and performs image processing on the captured image to detect a vehicle.

(Step S12) The traffic flow estimator 12 estimates and classifies a traffic flow on the basis of a result detected by the vehicle detector 11 and threshold values stored in the storage unit 15.

(Step S13) The traffic flow estimator 12 generates inter-vehicle time control instructions for the host vehicle and a vehicle traveling behind the host vehicle on the basis of the estimation and classification result. Successively, the traffic flow estimator 12 outputs the generated inter-vehicle time control instruction with respect to the host vehicle to the host vehicle. Successively, the traffic flow estimator 12 transmits the generated inter-vehicle time control instruction for the vehicle traveling behind the host vehicle to the vehicle traveling behind the host vehicle.

<Vehicle Detection Processing>

Figure 19:
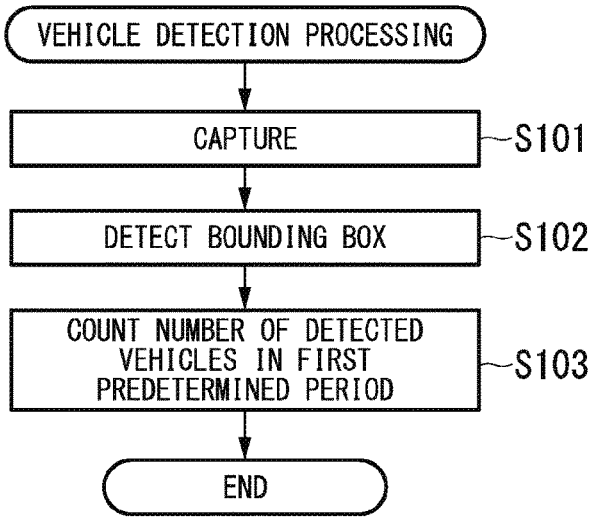
FIG. 19 is a flowchart of vehicle detection processing according to the embodiment.

Next, the vehicle detecting processing of step S11 (FIG. 18) will be further described. FIG. 19 is a flowchart of the vehicle detecting processing according to the present embodiment.

(Step S101) The imaging unit 111 captures a forward view image of the host vehicle in which the traffic flow estimation apparatus 10 is mounted.

(Step S102) The image processor 112 extracts bounding boxes BB from the captured image using the inference model data stored in the storage unit 15.

(Step S103) The detector 113 detects the number of bounding boxes (the number of vehicles) for each first predetermined period T1 on the basis of coordinates of the bounding boxes BB.

<Traffic Flow Estimation Processing>

Figure 20:
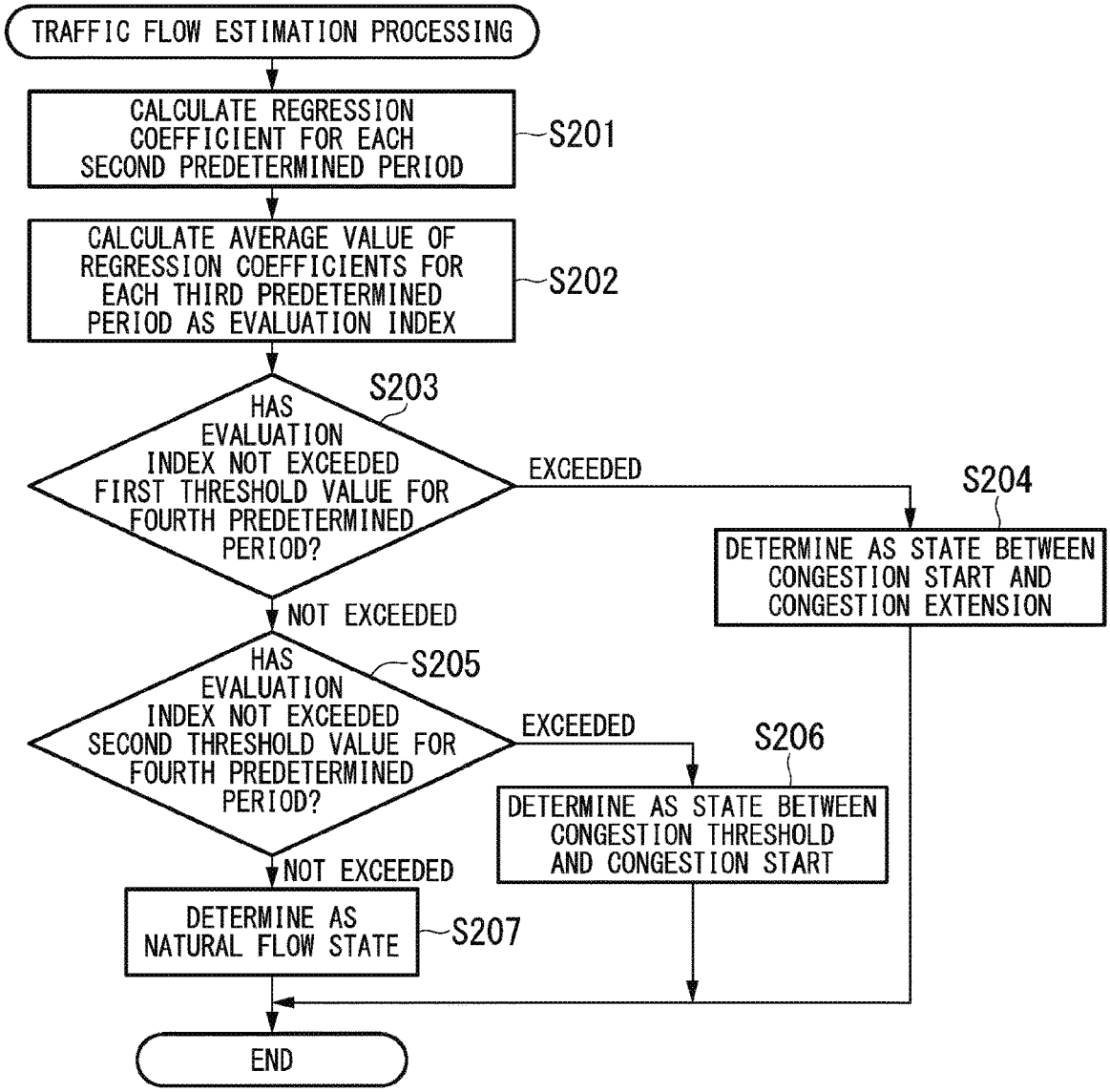
FIG. 20 is a flowchart of traffic flow estimation processing according to the embodiment.

Next, the traffic flow estimation processing of step S12 (FIG. 18) will be further described. FIG. 20 is a flowchart of the traffic flow estimation processing according to the present embodiment.

(Step S201) The evaluation index calculation unit 122 calculates a regression coefficient for each period of the second predetermined period T2 for the acquired number of detected vehicles.

(Step S202) The evaluation index calculation unit 122 calculates an average value of regression coefficients for each third predetermined period T3 as an evaluation index.

(Step S203) The congestion state determination unit 123 determines whether or not the evaluation index (the average value of the regression coefficients) has exceeded the first threshold value for the fourth predetermined period T4. When it is determined that the evaluation index has not exceeded the first threshold value for the fourth predetermined period T4 (step S203; not exceeded), the congestion state determination unit 123 proceeds to processing of step S205. When it is determined that the evaluation index has exceeded the first threshold value for the fourth predetermined period T4 (step S203; exceeded), the congestion state determination unit 123 proceeds to processing of step S204.

(Step S204) The congestion state determination unit 123 determines a traffic flow as a state between congestion start and congestion extension. After processing, the congestion state determination unit 123 ends the traffic flow estimation processing.

(Step S205) The congestion state determination unit 123 determines whether or not the average value of the regression coefficients has exceeded the second threshold value for the fourth predetermined period T4. When it is determined that the average value of the regression coefficients has not exceeded the second threshold value for the fourth predetermined period T4 (step S205; not exceeded), the congestion state determination unit 123 proceeds to processing of step S207. When it is determined that the average value of the regression coefficients has exceeded the second threshold value for the fourth predetermined period T4 (step S205; exceeded), the congestion state determination unit 123 proceeds to processing of step S206.

(Step S206) The congestion state determination unit 123 determines a traffic flow as a state between congestion threshold and congestion start. After processing, the congestion state determination unit 123 ends the traffic flow estimation processing.

(Step S207) The congestion state determination unit 123 determines a traffic flow as a natural flow state (a state that does not reach congestion threshold). After processing, the congestion state determination unit 123 ends the traffic flow estimation processing.

In the present embodiment, an evaluation index necessary for traffic flow estimation can be appropriately calculated because the evaluation index (average value of regression coefficients) is obtained through the above-described procedure.

<Travel Control Processing>

Figure 21:
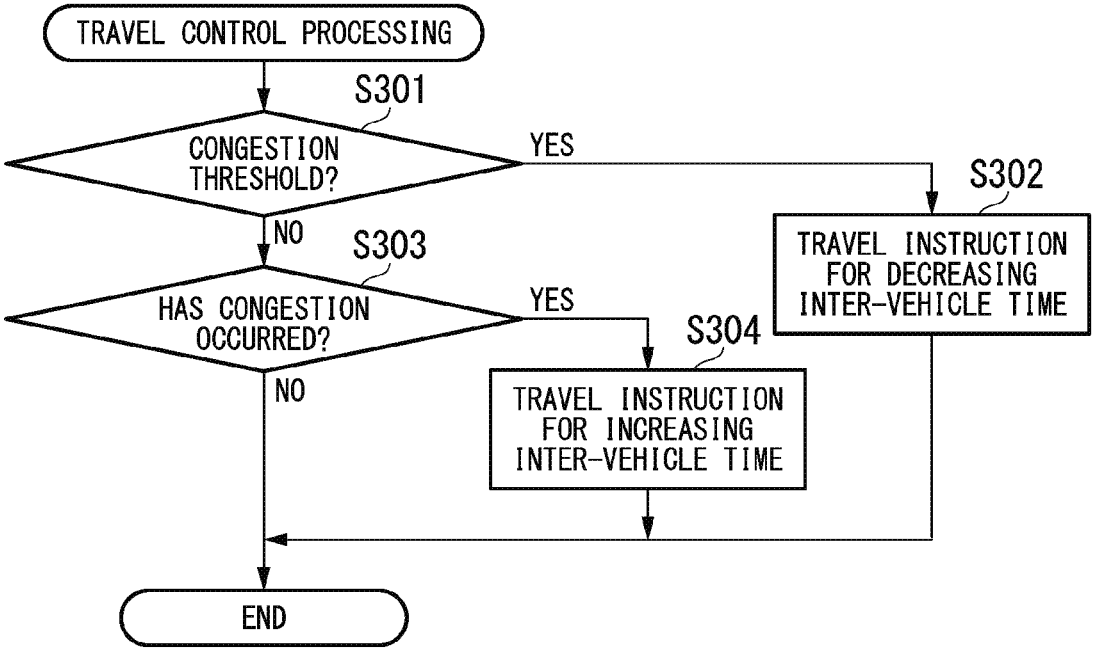
FIG. 21 is a flowchart of travel control processing according to the embodiment.

Next, the travel control processing of step S13 (FIG. 18) will be further described. FIG. 21 is a flowchart of the travel control processing according to the present embodiment.

(Step S301) The traffic flow controller 124 determines whether a traffic flow is a congestion threshold state. When it is determined that the traffic flow is a congestion threshold state (step S301; YES), the traffic flow controller 124 proceeds to processing of step S302. When it is determined that the traffic flow is not a congestion threshold state (step S301; NO), the traffic flow controller 124 proceeds to processing of step S303. When the congestion state determination unit 123 determines a traffic flow as a state between congestion threshold and congestion start, the traffic flow controller 124 determines that the traffic flow is a congestion threshold state.

(Step S302) The traffic flow controller 124 generates an inter-vehicle time control instruction for reducing a vehicle speed to decrease an inter-vehicle time (or inter-vehicle distance) to be shorter than a current state and outputs the generated inter-vehicle time control instruction to the communication unit 14. A state in which a traffic flow is at a congestion threshold is a state in which congestion has not yet occurred and seems about to occur. Accordingly, the traffic flow controller 124 performs control such that occurrence of a congestion is prevented by causing a following vehicle to reduce a vehicle speed to decrease an inter-vehicle time or an inter-vehicle distance to prevent lane change. After processing, the traffic flow controller 124 ends the travel control processing.

(Step S303) The traffic flow controller 124 determines whether a traffic flow is a congestion occurrence state. When it is determined that the traffic flow is a congestion occurrence state (step S303; YES), the traffic flow controller 124 proceeds to step S304. When it is determined that the traffic flow is not a congestion occurrence state (step S303; NO), the traffic flow controller 124 ends the processing. When the congestion state determination unit 123 determines that a traffic flow is a state between congestion start and congestion extension, the traffic flow controller 124 determines that the traffic flow is congestion start.

(Step S304) The traffic flow controller 124 generates an inter-vehicle time control instruction for increasing an inter-vehicle time (or inter-vehicle distance) to be longer than in a current state and outputs the generated inter-vehicle time control instruction to the communication unit 14. A state in which a traffic flow is congestion start is a state in which congestion has already occurred and a later stage of congestion threshold (congestion threshold later stage). Accordingly, the traffic flow controller 124 performs control such that transition from congestion start to congestion extension is prevented by causing a following vehicle to increase an inter-vehicle time or an inter-vehicle distance such that congestion is not intensified in order to prevent a congestion length from extending. After processing, the traffic flow controller 124 ends the travel control processing.

The host vehicle in which the traffic flow estimation apparatus 10 is mounted controls an inter-vehicle time or an inter-vehicle distance between the host vehicle and other vehicles on the basis of the inter-vehicle time control instruction output from the traffic flow estimation apparatus 10.

<Transmission of Inter-Vehicle Time Control Instruction>

Figure 22:
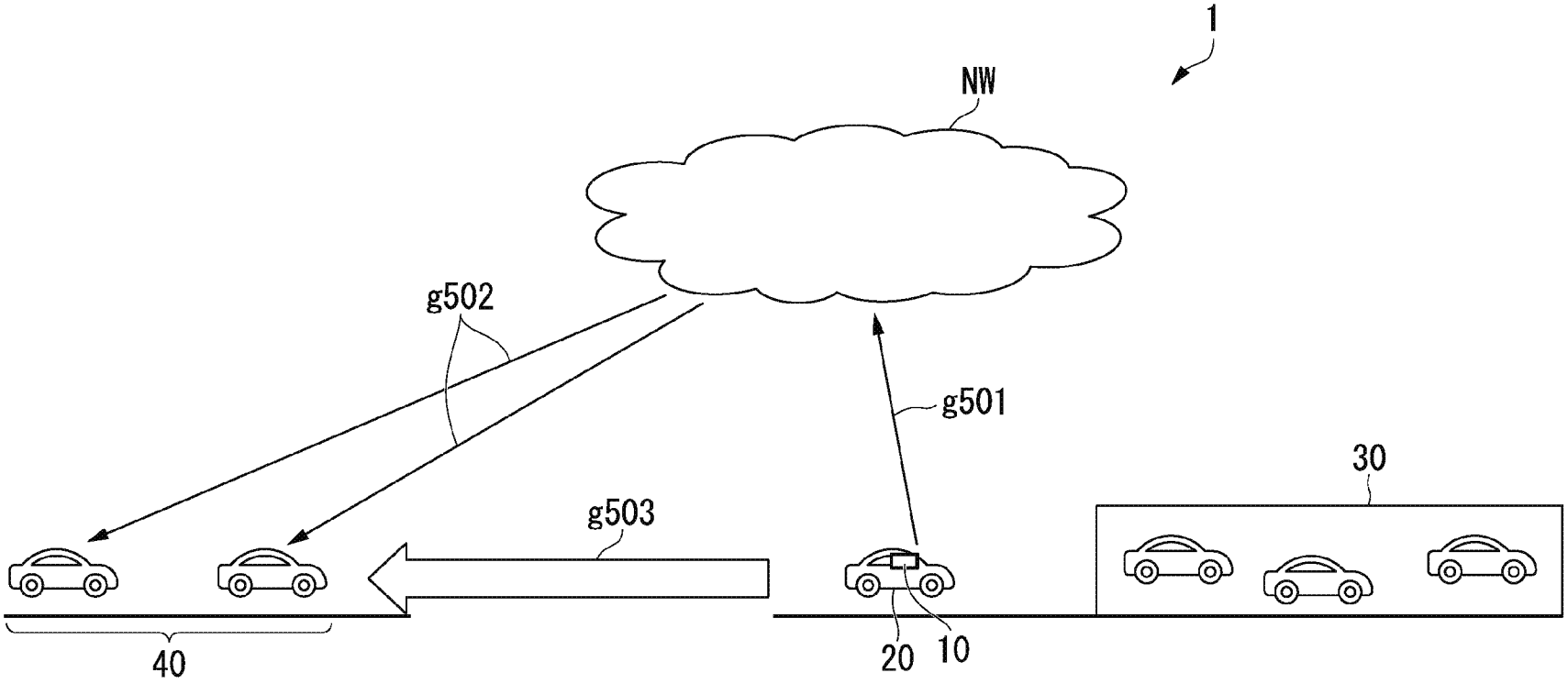
FIG. 22 is a diagram showing an example of a method of transmitting an inter-vehicle time control instruction according to the embodiment.

Next, a method of transmitting an inter-vehicle time control instruction will be described. FIG. 22 is a diagram showing an example of a method of transmitting an inter-vehicle time control instruction according to the present embodiment. A vehicle 20 is a vehicle in which the traffic flow estimation apparatus 10 is mounted. A vehicle 30 is a vehicle traveling in front of the vehicle 20 in a travel direction of the vehicle 20. A vehicle 40 is a vehicle traveling behind the vehicle 20 in the travel direction of the vehicle 20.

The traffic flow estimation apparatus 10 performs congestion indication through the above-described method. When it is determined that a traffic flow is a congestion threshold initial state (when a congestion indication has been detected), the traffic flow estimation apparatus 10 transmits travel information including information for notification of a state in which congestion is indicated in front to the vehicle 40 traveling behind through a network NW. Next, the traffic flow estimation apparatus 10 transmits travel information including an instruction for decreasing an inter-vehicle time or an inter-vehicle distance to the vehicle 40 traveling behind. Accordingly, it is possible to curb or inhibit lane change by controlling travel of a following vehicle such that an inter-vehicle time or an inter-vehicle distance is reduced in the present embodiment. As a result, according to the present embodiment, it is possible to curb or inhibit transition from congestion threshold to congestion start. When a congestion threshold later stage state is determined, the traffic flow estimation apparatus 10 transmits travel information including an instruction for increasing an inter-vehicle time or an inter-vehicle distance. Accordingly, in the present embodiment, travel of a following vehicle is controlled such that an inter-vehicle time or an inter-vehicle distance increases, and thus lane change is not curbed.

Although a case in which a traffic flow is determined as a congestion threshold state has been described in the aforementioned example, the traffic flow estimation apparatus 10 transmits travel information including an instruction for increasing an inter-vehicle time to the vehicle 40 traveling behind when the traffic flow is determined as a congestion start state.

Another Examples of Travel Control and Notification

Figure 23:
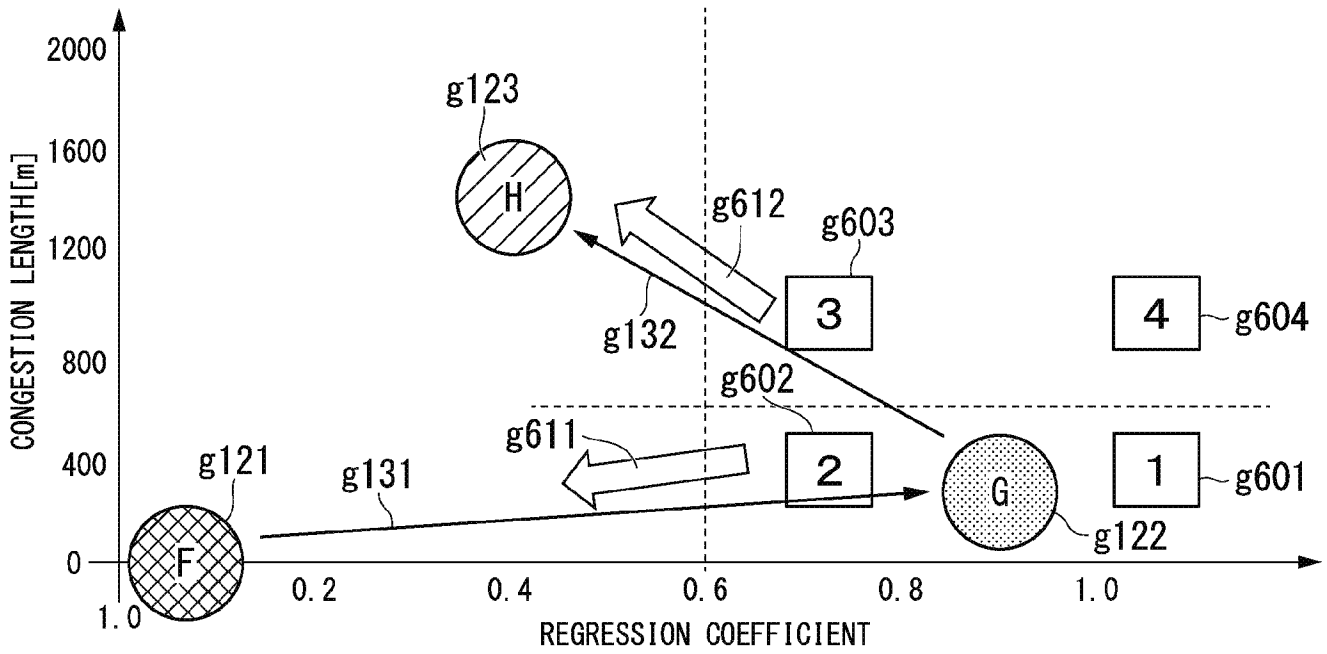
FIG. 23 is a diagram for describing another example of travel control and notification according to the embodiment.

Next, another example of travel control and notification will be described. FIG. 23 is a diagram for describing another example of travel control and notification according to the present embodiment. In FIG. 23, reference signs g121 to g123, g131 and g132 are the same as those of FIG. 8. Further, reference signs g601 to g604 represent combinations of regression coefficients and congestion lengths. The horizontal axis represents a regression coefficient and the vertical axis represents a congestion length [m].

Details of travel control instructions are different for the respective states shown in FIG. 23.

A state of reference sign g601 is a state in which the regression coefficient (an average value of regression coefficients including the regression coefficient) has increased from a congestion start state (g122) without congestion length change.

A state of reference sign g602 is a state in which the regression coefficient (an average value of regression coefficients including the regression coefficient) has decreased from the congestion start state (g122) without congestion length change.

A state of reference sign g603 is a state in which the congestion length has extended and the regression coefficient (an average value of regression coefficients including the regression coefficient) has decreased from congestion start (g122).

A state of reference sign g604 is a state in which the congestion length has extended and the regression coefficient (an average value of regression coefficients including the regression coefficient) has increased from the congestion start state (g122).

In the case of the states of reference signs g601 and g603, it is desirable that the traffic flow estimator 12 cause a following vehicle to increase an inter-vehicle distance and perform travel control such that a lane change execution rate increases.

In the case of the states of reference signs g602 and g604, it is desirable that the traffic flow estimator 12 cause a following vehicle to decrease an inter-vehicle distance and perform travel control such that a lane change execution rate is reduced.

Alternatively, in the case of the states of reference signs g603 and g604, the traffic flow estimator 12 may transmit information for promoting a rest of a following vehicle or guiding the following vehicle to a service station or the like (e.g., promoting refueling of gasoline) to the following vehicle, for example.

Reference sign g611 represents a state of transition from congestion start to congestion threshold. In the case of the state of reference sign g611, the traffic flow estimator 12 may transmit information representing cancellation of congestion indication, such as "congestion indication has been cancelled!", for example, to a following vehicle.

Reference sign g612 represents a state of transition from congestion start to congestion extension. In the case of the state of reference sign g612, the traffic flow estimator 12 may transmit information representing that congestion has occurred and the length of the congestion has extended, such as "congestion extension has occurred!", for example, to a following vehicle.

<Verification Results>

Next, results of simulations of a case in which a vehicle traveling behind has reduced the speed and a case in which the vehicle has not reduced the speed when congestion threshold has been detected will be described. A simulation condition is that the number of vehicles traveling in front of the traffic flow estimation apparatus 10 of the host vehicle in which the traffic flow estimation apparatus 10 is mounted is equal to or greater than a predetermined number. Speeds of following vehicles are 70 to 100 (km/h).

Figure 24:
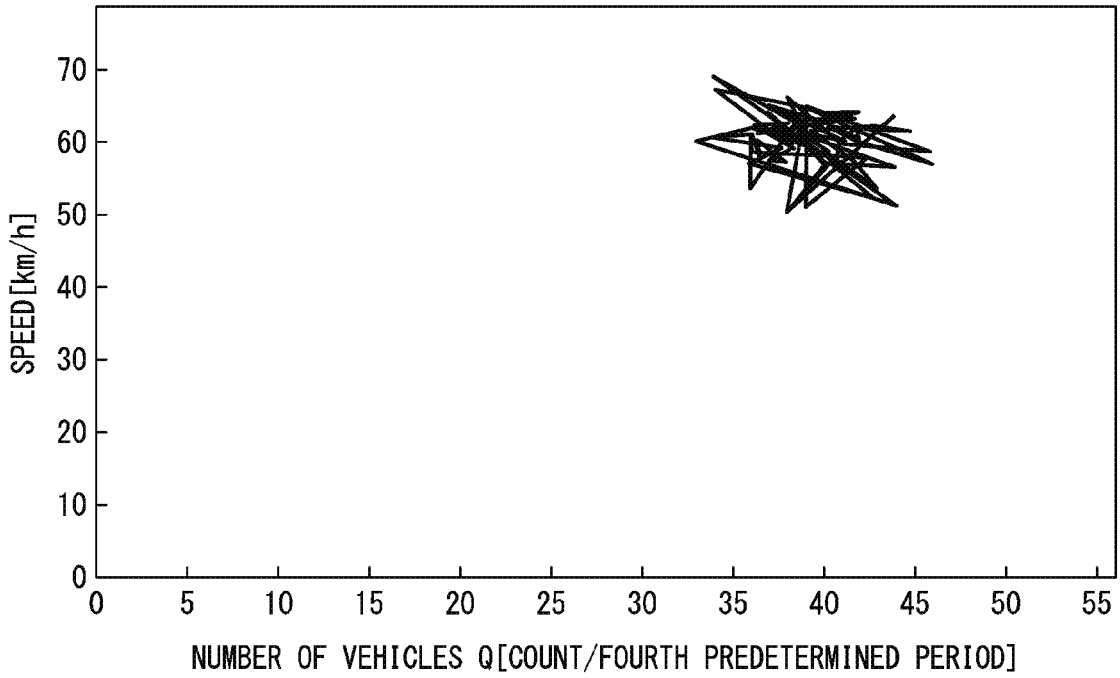
FIG. 24 is a diagram showing an example of a QV map when a following vehicle has decreased an inter-vehicle time when a congestion threshold has been detected according to the embodiment.

FIG. 24 is a diagram showing an example of a QV map when a following vehicle has decreased an inter-vehicle distance when congestion threshold has been detected according to the present embodiment. In FIG. 24, the horizontal axis represents the number of vehicles Q (number/third predetermined period) (traffic volume) and the vertical axis represents a speed (km/h).

As shown in FIG. 24, a group of a number of vehicles whose speeds are detected as 50 to 70 (km/h) is formed when an inter-vehicle distance is reduced to be shorter than a current state and thus a vehicle group in a low speed region (e.g., 50 (k./h) or lower) as represented by reference sign g352 of FIG. 15 is not generated. That is, this means that congestion does not occur when an inter-vehicle distance is reduced.

Figure 25:
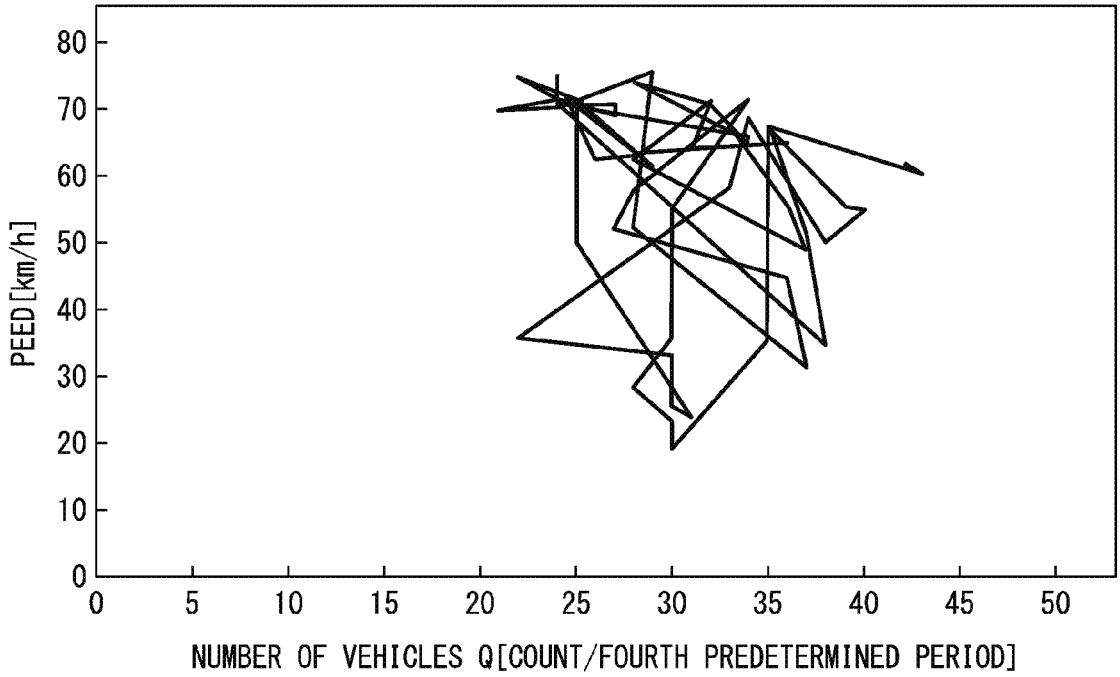
FIG. 25 is a diagram showing an example of a QV map when a following vehicle has not decreased an inter-vehicle time when a congestion threshold has been detected according to the embodiment.

FIG. 25 is a diagram showing an example of a QV map when a following vehicle has not decreased an inter-vehicle distance when congestion threshold of a comparison target has been detected. In FIG. 25, the horizontal axis and the vertical axis are the same as those of FIG. 24.

As shown in FIG. 25, a group of a number of vehicles whose speeds are detected as 20 to 80 (km/h) is formed when an inter-vehicle distance is not reduced to be shorter than a current state and thus a vehicle group in a low speed region (e.g., 50 (km/h) or lower) as represented by reference sign g352 of FIG. 15 is generated. That is, this means that congestion occurs when an inter-vehicle distance is not reduced.

According to the verification results shown in FIG. 24 and FIG. 25, when control for causing a following vehicle to reduce an inter-vehicle distance or an inter-vehicle time when a congestion threshold initial stage has been detected is performed as in the present embodiment, congestion indication can be controlled.

As described above, in the present embodiment, the number of preceding vehicles is detected on the basis of a captured image and a learning model. In addition, in the present embodiment, change in a time series of the detected number of preceding vehicles is calculated as regression coefficients and an average value of the calculated regression coefficients is calculated as an evaluation index. In the present embodiment, a traffic flow is estimated using the calculated evaluation index.

Therefore, according to the present embodiment, it is possible to estimate a traffic flow with high accuracy. According to the present embodiment, it is possible to curb congestion occurrence or extension by transmitting an instruction for decreasing an inter-vehicle distance or an inter-vehicle time in an initial stage of congestion threshold or instruction for increasing an inter-vehicle distance or an inter-vehicle time in a later stage of congestion threshold. According to the present embodiment, it is possible to curb congestion occurrence or extension by transmitting an instruction for decreasing an inter-vehicle time or an instruction for increasing the inter-vehicle time to a following vehicle on the basis of a congestion prediction result.

All or some processes performed by the traffic flow estimation apparatus 10 in the present invention may be performed by recording a program for realizing all or some functions of the traffic flow estimation apparatus 10 on a computer-readable recording medium and causing a computer system to read and execute the program recorded on the recording medium. It is assumed that the "computer system" mentioned here includes an OS and hardware such as peripheral devices. It is assumed that the "computer system" includes a WWW system including a homepage providing environment (or display environment). The "computer-readable recording medium" refers to portable media such as a flexible disc, a magneto-optical disk, a ROM and a CD-ROM, and a storage device such as a hard disk embedded in a computer system. Further, it is assumed that the "computer-readable recording medium" includes a recording medium storing a program for a specific time such, as a volatile memory (RAM) in a computer system serving as a server or a client when the program has been transmitted through a network such as the Internet or a communication circuit such as a telephone circuit.

The aforementioned program may be transmitted to other computer systems from a computer system that stores the program in a storage device or the like via a transmission medium or through transmitted waves in the transmission medium. Here, the "transmission medium" refers to a medium having a function of transmitting information, such as a network (communication network) such as the Internet and a communication circuit (communication line) such as a telephone circuit. The aforementioned program may realize some of the above-described functions. Further, the program may be a program that can realize the above-described functions by being combined with a program that has already been recorded on the computer system, so-called a difference file (difference program).

While forms for carrying out the present invention have been described using the embodiments, the present invention is not limited to these embodiments at all, and various modifications and substitutions can be made without departing from the gist of the present invention.

What is claimed is:

1. A traffic flow estimation apparatus comprising:

a processor configured to:

detect based on a learning model and a binarization of image information representative of a number of preceding vehicles in front of the traffic flow estimation apparatus;

estimate a traffic flow from the number of preceding vehicles;

acquire a time series of the number of preceding vehicles in a first predetermined period as a vehicle number time series;

calculate an evaluation index of the vehicle number time series in the first predetermined period;

determine the traffic flow of the preceding vehicles on the basis of the evaluation index; and notify a following vehicle behind the traffic flow estimation apparatus of an indication with respect to travel on the basis of the traffic flow of the preceding vehicles.

2. The traffic flow estimation apparatus according to claim 1, wherein the evaluation index is calculated using a plurality of regression coefficients of change in the number of preceding vehicles detected with respect to time in a second predetermined period longer than the first predetermined period.

3. The traffic flow estimation apparatus according to claim 2, wherein the evaluation index is calculated as an average value of the plurality of regression coefficients.

4. The traffic flow estimation apparatus according to claim 1, wherein the processor is configured to that the traffic flow is a congestion start state and causes the processor to transmit an inter-vehicle time control instruction for increasing an inter-vehicle time to the following vehicle as a notification related to curbing of congestion when the evaluation index is equal to or greater than a first threshold value.

5. The traffic flow estimation apparatus according to claim 4, wherein the processor is configured to determine that the traffic flow is a congestion threshold state and causes the processor to transmit the inter-vehicle time control instruction for decreasing the inter-vehicle time to the following vehicle as a notification related to curbing of congestion when the evaluation index is equal to or greater than a second threshold value equal to or less than the first threshold value.

6. The traffic flow estimation apparatus according to claim 4, wherein the processor is configured to transmit the inter-vehicle time control instruction for decreasing the inter-vehicle time to the following vehicle in at least one of a case in which the evaluation index decreases as compared to the congestion start state and a congestion length that is a length of congestion in the congestion start state does not change and a case in which the evaluation index increases as compared to the congestion start state and the congestion length extends as compared to the congestion start state after the congestion start state is determined.

7. The traffic flow estimation apparatus according to claim 4, wherein the processor is configured to transmit the inter-vehicle time control instruction for increasing the inter-vehicle time to the following vehicle in at least one of a case in which the evaluation index increases as compared to the congestion start state and a congestion length that is a length of congestion in the congestion start state does not change and a case in which the evaluation index decreases as compared to the congestion start state and the congestion length that is the length of the congestion extends as compared to the congestion start state after the congestion start state is determined.

8. The traffic flow estimation apparatus according to claim 1, wherein the processor is further configured to capture a forward view image of the traffic flow estimation apparatus and an image processor configured to perform image processing on the captured image, and detects a number of preceding vehicles included in the captured image as a number of vehicles.

9. The traffic flow estimation apparatus according to claim 8, wherein the processor uses the learning model learnt by a learning data set, wherein the learning model is a neural network model, the learning data set is data in which input data that is the image information photographed by a vehicle is associated with output data that is positional coordinates of a vehicle photographed in the image information, the learning model estimates positional coordinates of a preceding vehicle photographed in a forward view image by inputting the forward view image, and the processor detects a number of vehicle on the basis of the estimated positional coordinates.

10. The traffic flow estimation apparatus according to claim 9, wherein the image processor obtains positional coordinates of a bounding box that is a bounded region of a vehicle using the learning model for the captured image.

11. A traffic flow estimation method in a traffic flow estimation apparatus, comprising:

detecting based on a learning model and a binarization of image information representative of a number of preceding vehicles in front of the traffic flow estimation apparatus;

estimating a traffic flow from the number of preceding vehicles;

acquiring a time series of the number of preceding vehicles in a first predetermined period as a vehicle number time series;

calculating an evaluation index of the vehicle number time series in the first predetermined period;

determining a congestion state of the preceding vehicles on the basis of the evaluation index; and notifying a following vehicle behind the traffic flow estimation apparatus of an indication with respect to travel on the basis of the congestion state of the preceding vehicles.

12. A non-transitory computer-readable storage medium storing a program causing a computer of a traffic flow estimation apparatus to:

detect based on a learning model and a binarization of image information representative of a number of preceding vehicles in front of the traffic flow estimation apparatus;

estimate a traffic flow from the number of preceding vehicles;

acquire a time series of the number of preceding vehicles in a first predetermined period as a vehicle number time series;

calculate an evaluation index of the vehicle number time series in the first predetermined period;

determine a congestion state of the preceding vehicles on the basis of the evaluation index; and notify a following vehicle behind the traffic flow estimation apparatus of an indication with respect to travel on the basis of the congestion state of the preceding vehicles.

* * * * *